US010665157B2

(12) United States Patent
Lin et al.

(10) Patent No.: US 10,665,157 B2
(45) Date of Patent: May 26, 2020

(54) PRE-COMPENSATION FOR PRE-TOGGLING-INDUCED ARTIFACTS IN ELECTRONIC DISPLAYS

(71) Applicant: Apple Inc., Cupertino, CA (US)

(72) Inventors: Hung Sheng Lin, San Jose, CA (US); Shengkui Gao, San Jose, CA (US); Yingying Tang, Sunnyvale, CA (US); Sean C. Chang, Mountain View, CA (US); Mohammad B. Vahid Far, San Jose, CA (US); Kasra M. Omid-Zohoor, Sunnyvale, CA (US); Chumin Zhao, Sunnyvale, CA (US); Jingyu Huang, Sunnyvale, CA (US); Mohammad Ali Jangda, San Jose, CA (US); Hyunwoo Nho, Stanford, CA (US); Chaohao Wang, Sunnyvale, CA (US); Marc J. DeVincentis, Palo Alto, CA (US); Marc Albrecht, San Francisco, CA (US); Warren S. Rieutort-Louis, Cupertino, CA (US)

(73) Assignee: Apple Inc., Cupertino, CA (US)

( * ) Notice: Subject to any disclaimer, the term of this patent is extended or adjusted under 35 U.S.C. 154(b) by 0 days.

(21) Appl. No.: 16/374,606

(22) Filed: Apr. 3, 2019

(65) Prior Publication Data

US 2019/0325816 A1 Oct. 24, 2019

Related U.S. Application Data

(60) Provisional application No. 62/659,352, filed on Apr. 18, 2018.

(51) Int. Cl.
*G09G 3/3208* (2016.01)
*G09G 3/20* (2006.01)

(52) U.S. Cl.
CPC ..... *G09G 3/3208* (2013.01); *G09G 3/2055* (2013.01); *G09G 2320/0209* (2013.01); *G09G 2320/0626* (2013.01)

(58) Field of Classification Search
CPC ..... G09G 3/3233; G09G 2320/0626; G09G 3/3208; G09G 2320/0209;
(Continued)

(56) References Cited

U.S. PATENT DOCUMENTS 7,404,645 B2 7/2008 Margulis
8,427,404 B2 * 4/2013 Thiebaud ..... G09G 3/3648 345/82

(Continued)

*Primary Examiner* — Muhammad N Edun
(74) *Attorney, Agent, or Firm* — Fletcher Yoder, P.C.

(57) ABSTRACT

Systems and methods reduce likelihood of hysteresis that reduces perceived image quality of a subsequent image frame by toggling the display pixels to relax the display pixels by overwriting previous image frame data. During non-emission periods of the pixels, the pixels may be pre-toggled or exercised to improve response time and accuracy of the pixel. Data for pixels being programmed may also be used to pre-toggle other pixels reducing overhead but increasing cross-talk. Since the amount of cross-talk is related to content of the pixels being pre-toggled, a line buffer may be used to store image data for the pixels being pre-toggled. This stored image data may be used to determine how much pre-compensation is to be applied to data for the pixels being programmed. In other words, an amount of compensation applied is based at least in part on the content (e.g., greyscale levels) of the image data.

25 Claims, 16 Drawing Sheets

(58) Field of Classification Search
CPC ..... G09G 2320/045; G09G 2300/0861; G09G 2300/0842; G09G 2310/0251; G09G 2300/0819; G09G 3/3275; G09G 2340/16; G09G 3/2055; G09G 3/2051; G09G 2320/0257
See application file for complete search history.

(56) References Cited

U.S. PATENT DOCUMENTS

| | | | | |
|---|---|---|---|---|
| 8,797,370 | B2 | 8/2014 | Cho et al. | |
| 9,370,075 | B2 | 6/2016 | Chaji et al. | |
| 9,875,686 | B2 | 1/2018 | Yin et al. | |
| 9,881,587 | B2 * | 1/2018 | Chaji | G09G 5/10 |
| 2010/0295844 | A1 * | 11/2010 | Hayashi | G09G 3/2096 345/214 |
| 2018/0061302 | A1 * | 3/2018 | Hu | G09G 3/2074 |

* cited by examiner

PRE-COMPENSATION FOR PRE-TOGGLING-INDUCED ARTIFACTS IN ELECTRONIC DISPLAYS

CROSS-REFERENCE TO RELATED APPLICATIONS

This application claims priority to U.S. Provisional Patent Application No. 62/659,352, entitled "PRE-COMPENSATION FOR PRE-TOGGLING-INDUCED ARTIFACTS IN ELECTRONIC DISPLAYS," filed on Apr. 18, 2018, which is incorporated herein by reference in its entirety for all purposes.

BACKGROUND

The present disclosure relates generally to electronic displays and, more particularly, for improving response time in the electronic displays.

This section is intended to introduce the reader to various aspects of art that may be related to various aspects of the present techniques, which are described and/or claimed below. This discussion is believed to be helpful in providing the reader with background information to facilitate a better understanding of the various aspects of the present disclosure. Accordingly, it should be understood that these statements are to be read in this light, and not as admissions of prior art.

Electronic devices often use electronic displays to present visual representations of information as text, still images, and/or video by displaying one or more image frames. For example, such electronic devices may include computers, mobile phones, portable media devices, tablets, televisions, virtual-reality headsets, vehicle dashboards, and wearable devices, among many others. To accurately display an image frame, an electronic display may control light emission (e.g., luminance) from its display pixels. However, light emission of a display pixel for displaying an image frame may be affected by the light emission of the display pixel for displaying one or more previous image frames, a phenomenon known as hysteresis. The hysteresis exhibited by the display pixels of the electronic display may result in slow response time of the display pixels, which may affect perceived image quality of the electronic display, for example, by producing ghost images or mura effects. Moreover, for current-driven displays, such as organic light-emitting diode (OLED) displays, the response time may be even slower when displaying low luminance images or during short persistent modes.

SUMMARY

A summary of certain embodiments disclosed herein is set forth below. It should be understood that these aspects are presented merely to provide the reader with a brief summary of these certain embodiments and that these aspects are not intended to limit the scope of this disclosure. Indeed, this disclosure may encompass a variety of aspects that may not be set forth below.

To reduce likelihood of hysteresis that reduces perceived image quality of a subsequent image frame, an electronic display may reset the display pixels (e.g., a target voltage may be applied to the display pixels) to relax the display pixels by overwriting previous image frame data causing the hysteresis. In particular, the display pixels may emit light after programming the image data for the emission period, and then stop emitting light for the non-emission period (i.e., after the emission period). During the non-emission period, the display pixels may be reset. As image frames are typically displayed row (of display pixels) by row, each row may be sequentially programmed with image data and instructed to emit and then stop emitting light.

During the non-emission periods of the pixels, the pixels may be pre-toggled or exercised to improve response time and accuracy of the pixel. To reduce calculation overhead of this pre-toggling, data for pixels being programmed may also be used to pre-toggle other pixels. However, cross-talk between the pixels being programmed and the pixels being pre-toggled may negatively impact the data programmed into the pixels being programmed. Since the amount of cross-talk is related to content of the pixels being pre-toggled, a line buffer may be used to store image data for the pixels being pre-toggled. This stored image data may be used to determine how much pre-compensation is to be applied to data for the pixels being programmed. In other words, an amount of compensation applied is based at least in part on the content (e.g., greyscale levels) of the image data. In some embodiments, this amount of compensation may also be based at least in part on a digital brightness value (DBV) that corresponds to a global brightness setting for the electronic display.

BRIEF DESCRIPTION OF THE DRAWINGS

Various aspects of this disclosure may be better understood upon reading the following detailed description and upon reference to the drawings in which.

DETAILED DESCRIPTION

One or more specific embodiments of the present disclosure will be described below. These described embodiments are only examples of the presently disclosed techniques. Additionally, in an effort to provide a concise description of these embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but may nevertheless be a routine undertaking of design, fabrication, and manufacture for those of ordinary skill having the benefit of this disclosure.

When introducing elements of various embodiments of the present disclosure, the articles "a," "an," and "the" are intended to mean that there are one or more of the elements. The terms "including" and "having" are intended to be inclusive and mean that there may be additional elements other than the listed elements. Additionally, it should be understood that references to "one embodiment," "an embodiment," "embodiments," and "some embodiments" of the present disclosure are not intended to be interpreted as excluding the existence of additional embodiments that also incorporate the recited features.

Figure 1:
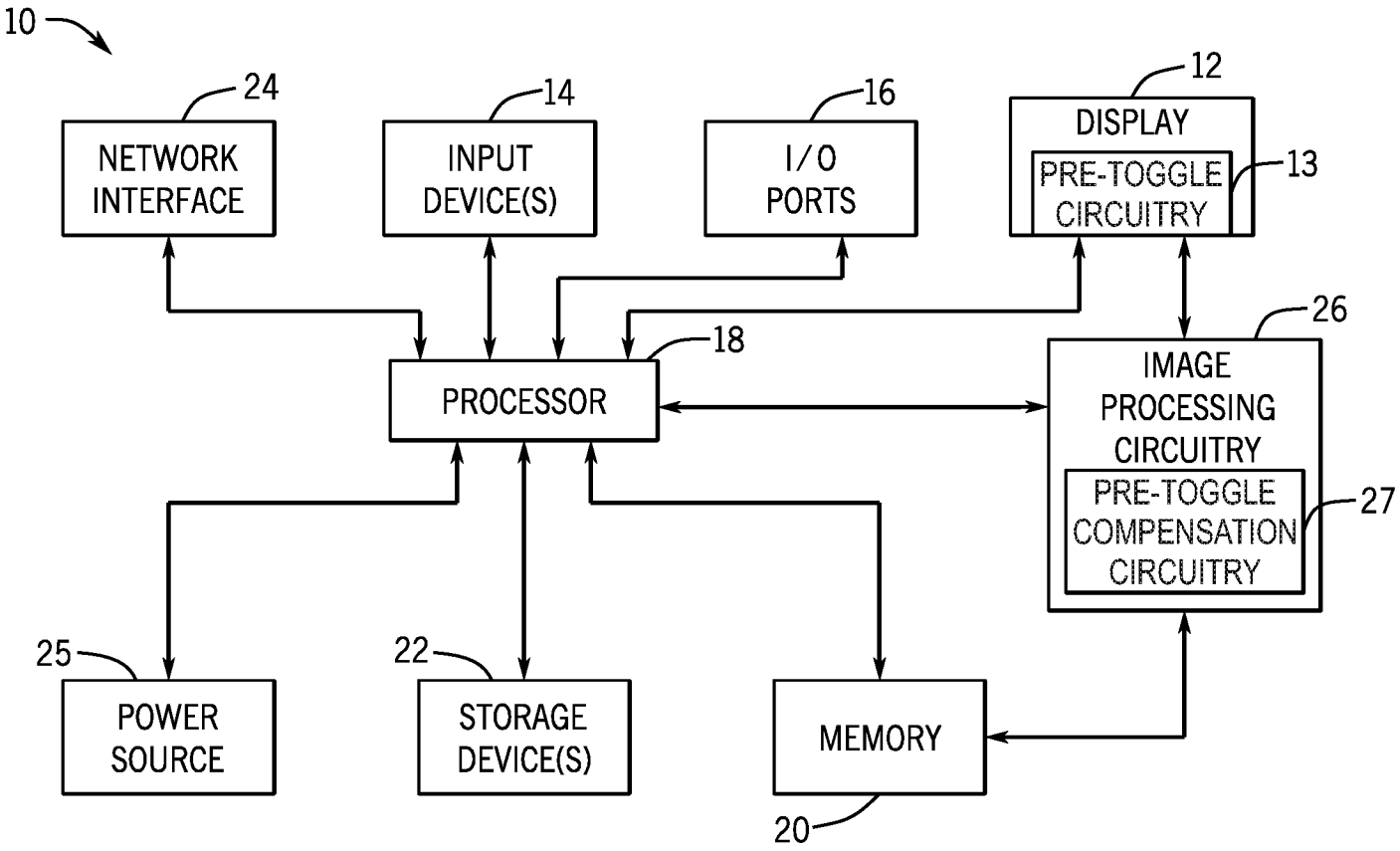
FIG. 1 is a block diagram of an electronic device used to display image frames and having pre-toggling circuitry and pre-toggling compensation circuitry, in accordance with an embodiment of the present disclosure.

To reduce hysteresis, display pixels of an electronic display may be reset to relax the display pixels by overwriting previous image frame data causing the hysteresis. Where overwriting of previous frame data and pre-toggling of pixels is performed using programming data being programmed to a current pixel/row of pixels. As discussed below, this sharing of programming data to multiple rows may create artifacts. Thus, when a pixel data is being driven to the pixel/row of pixels, the data may be pre-compensated based on the content of the previous pixels/row of pixels being pre-toggled to compensate for the cross-talk that will occur due to the application of the programming data to multiple rows. To help illustrate, an electronic device 10 including an electronic display 12 is shown in FIG. 1. As illustrated, the display 12 includes pre-toggling circuitry 13 that utilizes data for a current pixel/row of pixels to pre-toggle or exercise previously emitted pixels/rows of pixels that have recently emitted display images. The pre-toggling overwrites the previous frame data in those previously emitted pixels/rows of pixels. However, as noted below, the pre-toggling may introduce artifacts into image data for the current pixel/row of pixels.

As will be described in more detail below, the electronic device 10 may be any suitable electronic device, such as a computer, a mobile phone, a portable media device, a tablet, a television, a virtual-reality headset, a vehicle dashboard, and the like. Thus, it should be noted that FIG. 1 is merely an example of a particular implementation and is intended to illustrate the types of components that may be present in the electronic device 10.

In the depicted embodiment, the electronic device 10 includes the electronic display 12, one or more input devices 14, one or more input/output (I/O) ports 16, a processor core complex 18 having one or more processor(s) or processor cores, local memory 20, a main memory storage device 22, a network interface 24, a power source 25, and image processing circuitry 26. The various components described in FIG. 1 may include hardware elements (e.g., circuitry), software elements (e.g., a tangible, non-transitory computer-readable medium storing instructions), or a combination of both hardware and software elements. It should be noted that, in some embodiments, the various depicted components may be combined into fewer components or separated into additional components. For example, the local memory 20 and the main memory storage device 22 may be included in a single component. Additionally, the image processing circuitry 26 (e.g., a graphics processing unit (GPU)) may be at least partially included in the processor core complex 18 and/or the display.

The image processing circuitry 26 includes pre-toggle compensation circuitry 27 that pre-compensates image data for cross-talk due to image data for a pixel/row of pixels being used to pre-toggle pixels/rows of pixels. In other words, the pre-toggle compensation circuitry 27 may be used to estimate pre-toggling cross-talk and pre-compensate image data for the pre-toggling cross-talk introduced by the pre-toggling circuitry 13 before the pre-toggling circuitry 13 applies pre-toggling to the display 12. In some embodiments, at least a portion of the pre-toggling compensation circuitry 27 may be included in the pre-toggling circuitry 13. As discussed below, the pre-toggle compensation circuitry 27 may store the content of data rows after the corresponding pixels are written and utilize the stored data row content to pre-compensate for an amount of cross-talk in image data for a future pixel/row of pixels where the amount of cross-talk is dependent upon the content of the data row and/or the position of the data row relative to the future pixel/row of pixels.

As depicted, the processor core complex 18 is operably coupled to the local memory 20 and the main memory storage device 22. Thus, the processor core complex 18 may execute instruction stored in local memory 20 and/or the main memory storage device 22 to perform operations, such as generating and/or transmitting image data. As such, the processor core complex 18 may include one or more general purpose microprocessors, one or more application specific processors (ASICs), one or more field programmable logic arrays (FPGAs), or any combination thereof. Furthermore, as previously noted, the processor core complex 18 may include one or more separate processing logical cores that each process data according to executable instructions.

In addition to the executable instructions, the local memory 20 and/or the main memory storage device 22 may store the data to be processed by the cores of the processor core complex 18. Thus, in some embodiments, the local memory 20 and/or the main memory storage device 22 may include one or more tangible, non-transitory, computer-readable media. For example, the local memory 20 may include random access memory (RAM) and the main memory storage device 22 may include read only memory (ROM), rewritable non-volatile memory such as flash memory, hard drives, optical discs, and the like.

As depicted, the processor core complex 18 is also operably coupled to the network interface 24. In some embodiments, the network interface 24 may facilitate communicating data with other electronic devices via network connections. For example, the network interface 24 (e.g., a radio frequency system) may enable the electronic device 10 to communicatively couple to a personal area network (PAN), such as a Bluetooth network, a local area network (LAN), such as an 802.11x Wi-Fi network, and/or a wide area network (WAN), such as a 4G or LTE cellular network.

Additionally, as depicted, the processor core complex 18 is operably coupled to the power source 25. In some embodiments, the power source 25 may provide electrical power to one or more component in the electronic device 10, such as the processor core complex 18 and/or the electronic display 12. Thus, the power source 25 may include any suitable source of energy, such as a rechargeable lithium polymer (Li-poly) battery and/or an alternating current (AC) power converter.

Furthermore, as depicted, the processor core complex 18 is operably coupled to the I/O ports 16. In some embodiments, the I/O ports 16 may enable the electronic device 10 to receive input data and/or output data using port connections. For example, a portable storage device may be connected to an I/O port 16 (e.g., universal serial bus (USB)), thereby enabling the processor core complex 18 to communicate data with the portable storage device.

As depicted, the electronic device 10 is also operably coupled to input devices 14. In some embodiments, the input device 14 may facilitate user interaction with the electronic device 10 by receiving user inputs. For example, the input devices 14 may include one or more buttons, keyboards, mice, trackpads, microphones, and/or the like. Additionally, in some embodiments, the input devices 14 may include touch-sensing components in the electronic display 12. In such embodiments, the touch sensing components may receive user inputs by detecting occurrence and/or position of an object touching the surface of the electronic display 12.

In addition to enabling user inputs, the electronic display 12 may include a display panel with one or more display pixels. As described above, the electronic display 12 may control light emission from the display pixels to present visual representations of information, such as a graphical user interface (GUI) of an operating system, an application interface, a still image, or video content, by display image frames based at least in part on corresponding image data. In some embodiments, the electronic display 12 may be a display using liquid crystal display (LCD), a self-emissive display, such as an organic light-emitting diode (OLED) display, or the like. Moreover, in some embodiments, the electronic display 12 may refresh display of an image and/or an image frame, for example, at 60 Hz (corresponding to refreshing 60 frames per second), 120 Hz (corresponding to refreshing 120 frames per second), and/or 240 Hz (corresponding to refreshing 240 frames per second).

As depicted, the electronic display 12 is operably coupled to the processor core complex 18 and the image processing circuitry 26. In this manner, the electronic display 12 may display image frames based at least in part on image data generated by the processor core complex 18 and/or the image processing circuitry 26. Additionally or alternatively, the electronic display 12 may display image frames based at least in part on image data received via the network interface 24 and/or the I/O ports 16.

Figure 2:
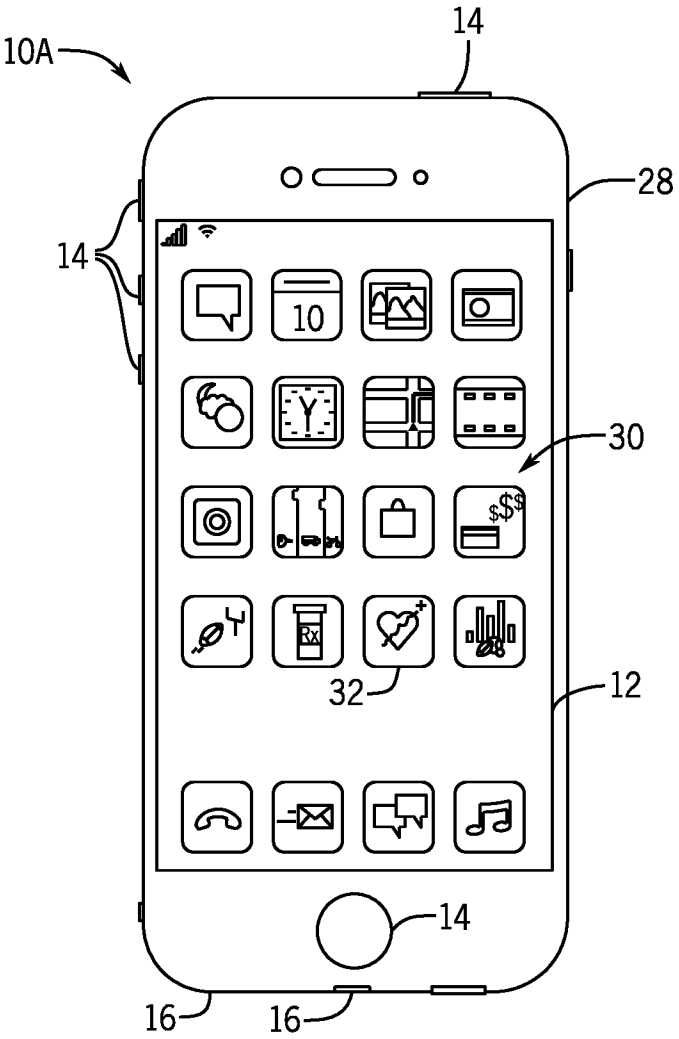
FIG. 2 is one example of the electronic device of FIG. 1, in accordance with an embodiment of the present disclosure.

As described above, the electronic device 10 may be any suitable electronic device. To help illustrate, one example of a suitable electronic device 10, specifically a handheld device 10A, is shown in FIG. 2. In some embodiments, the handheld device 10A may be a portable phone, a media player, a personal data organizer, a handheld game platform, and/or the like. For example, the handheld device 10A may be a smart phone, such as any IPHONE® model available from Apple Inc.

As depicted, the handheld device 10A includes an enclosure 28 (e.g., housing). In some embodiments, the enclosure 28 may protect interior components from physical damage and/or shield them from electromagnetic interference. Additionally, as depicted, the enclosure 28 surrounds the electronic display 12. In the depicted embodiment, the electronic display 12 is displaying a graphical user interface (GUI) 30 having an array of icons 32. By way of example, when an icon 32 is selected either by an input device 14 or a touch-sensing component of the electronic display 12, an application program may launch.

Furthermore, as depicted, input devices 14 may extend through the enclosure 28. As described above, the input devices 14 may enable a user to interact with the handheld device 10A. For example, the input devices 14 may enable the user to activate or deactivate the handheld device 10A, navigate a user interface to a home screen, navigate a user interface to a user-configurable application screen, activate a voice-recognition feature, provide volume control, and/or toggle between vibrate and ring modes. As depicted, the I/O ports 16 also open through the enclosure 28. In some embodiments, the I/O ports 16 may include an audio jack to connect to external devices. In some embodiments, the I/O ports 16 may include a speaker that outputs sounds from the handheld device 10A and/or a microphone that captures sounds at the handheld device 10A.

Figure 3:
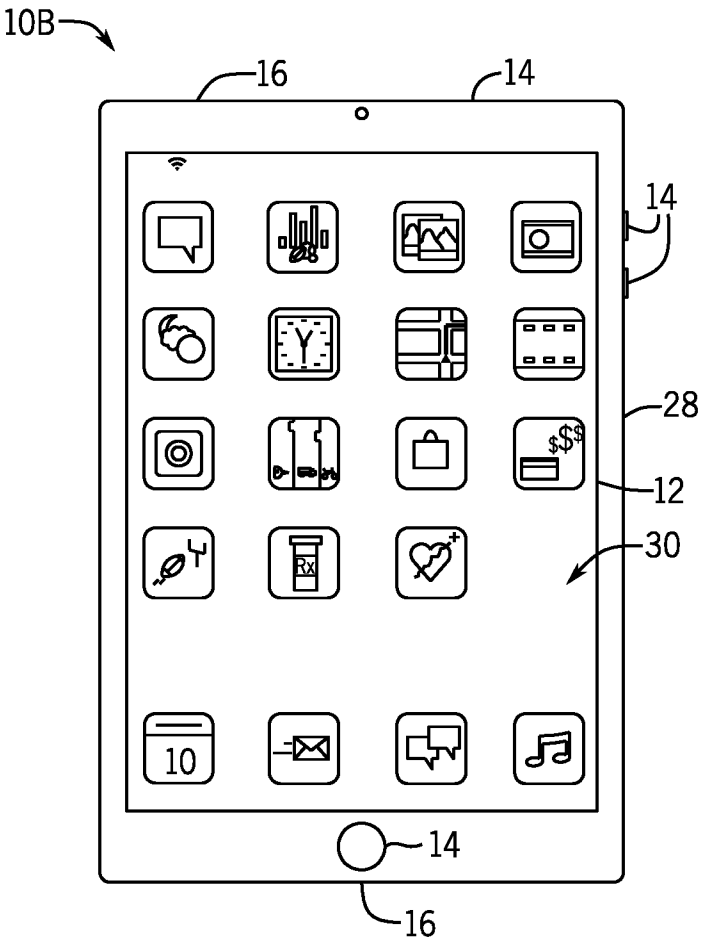
FIG. 3 is another example of the electronic device of FIG. 1, in accordance with an embodiment of the present disclosure.
Figure 4:
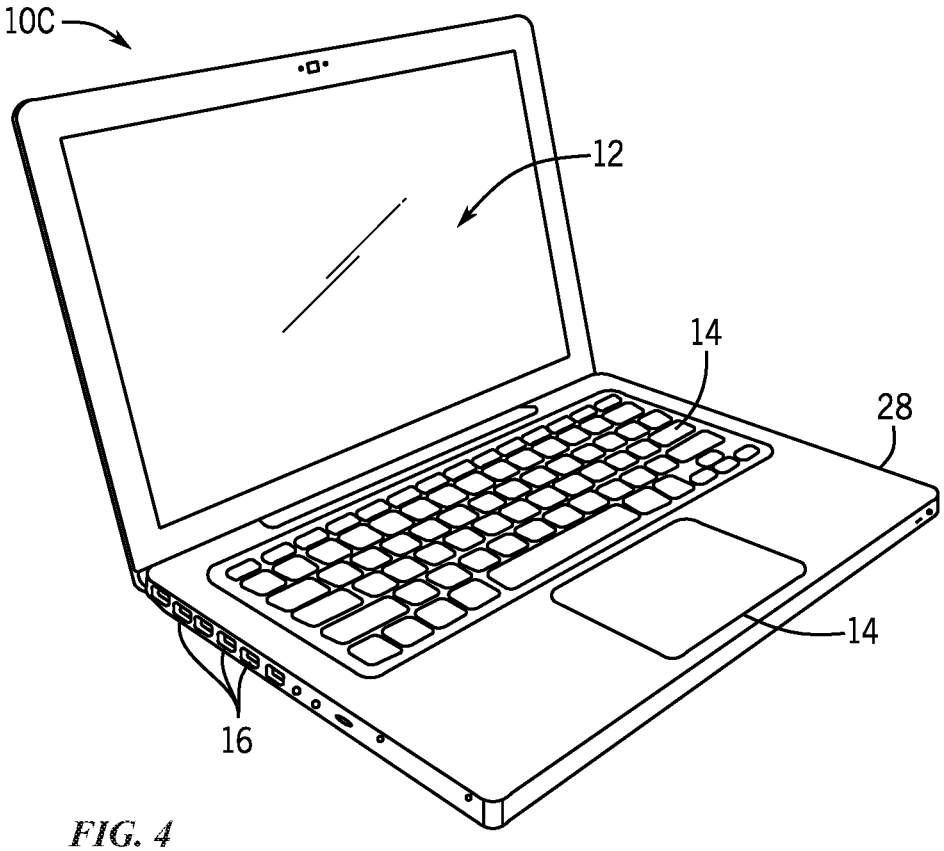
FIG. 4 is another example of the electronic device of FIG. 1, in accordance with an embodiment of the present disclosure.
Figure 5:
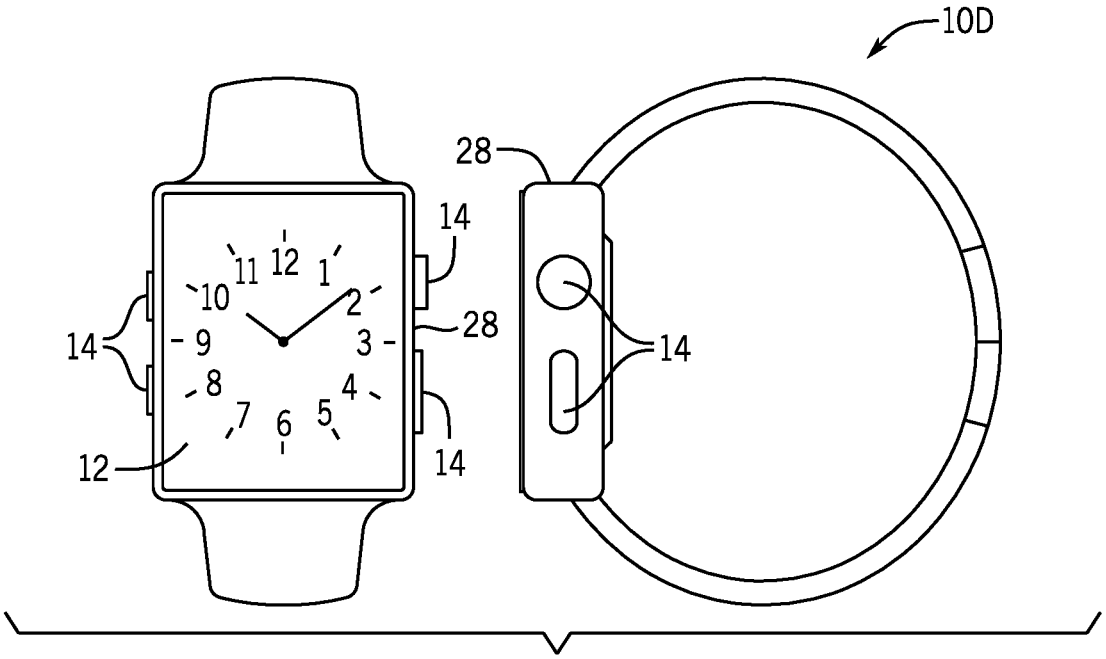
FIG. 5 is another example of the electronic device of FIG. 1, in accordance with an embodiment of the present disclosure.

To further illustrate an example of a suitable electronic device 10, specifically a tablet device 10B, is shown in FIG. 3. For illustrative purposes, the tablet device 10B may be any IPAD® model available from Apple Inc. A further example of a suitable electronic device 10, specifically a computer 10C, is shown in FIG. 4. For illustrative purposes, the computer 10C may be any MACBOOK® or IMAC® model available from Apple Inc. Another example of a suitable electronic device 10, specifically a wearable device 10D, is shown in FIG. 5. For illustrative purposes, the wearable device 10D may be any APPLE WATCH® model available from Apple Inc. As depicted, the tablet device 10B, the computer 10C, and the wearable device 10D each also includes an electronic display 12, input devices 14, and an enclosure 28.

Figure 6:
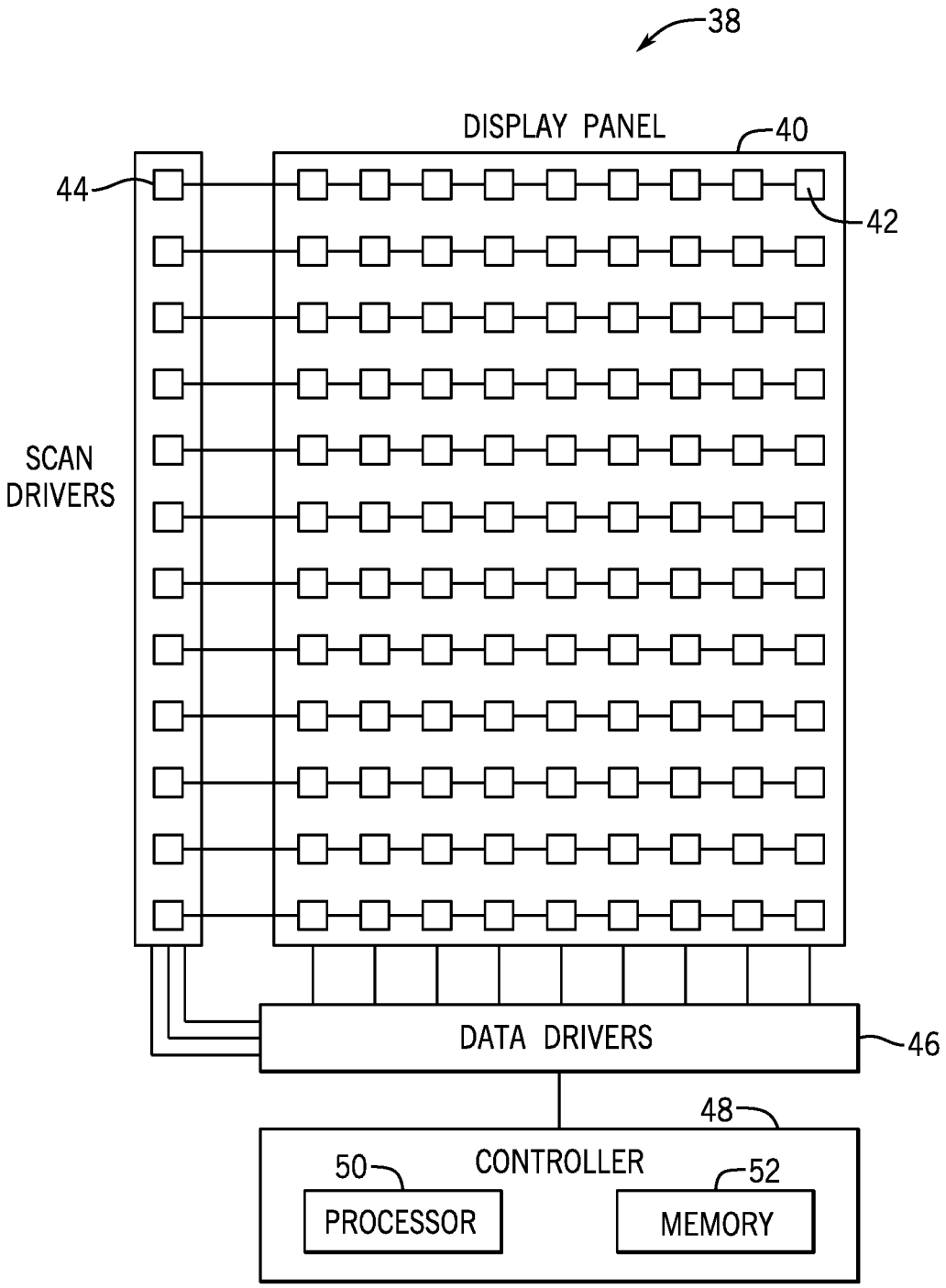
FIG. 6 is a high-level schematic diagram of display driver circuitry of the electronic display of FIG. 1, in accordance with an embodiment of the present disclosure.

With the foregoing in mind, a schematic diagram of display driver circuitry 38 of the electronic display 12 is shown in FIG. 6. The display driver circuitry 38 may include circuitry, such as one or more integrated circuits, state machines made of discrete logic and other components, and the like, that provide an interface function between the processor(s) of the processor core complex 18 and/or the image processing circuitry 26 and the display 12. As depicted, the display driver circuitry 38 includes a display panel 40 with multiple display pixels 42 arranged in rows and columns. A set of scan drivers 44 and a set of data drivers 46 are communicatively coupled to the display pixels 42. As illustrated, one scan driver 44 is communicatively coupled to each row of display pixels 42, and one data driver 46 is communicatively coupled to each column of display pixels 42. A scan driver 44 may supply one or more scan signals or control signals (e.g., voltage signals) to a display pixel row to control operation (e.g., programming, writing, and/or emission period) of the row. The scan drivers 44 may be daisy chained together, such that a single control signal may be sent to the set of scan drivers 44 to display an image frame. Timing of the control signal may be controlled by propagation of the control signal through the set of scan drivers 44. A data driver 46 may supply one or more data signals (e.g., voltage signals) to a display pixel column to program (e.g., write) one or more display pixel in the column. In some embodiments, electrical energy may be stored in a storage component (e.g., capacitor) of a display pixel to control magnitude of current (e.g., via one or more programmable current sources) to facilitate controlling light emission from the display pixel. It should be noted that any suitable arrangement of communicatively coupling scan drivers 44 and data drivers 46 to the display pixels 42 is contemplated (e.g., communicatively coupling one or more scan drivers 44 and/or one or more data drivers 46 to one or more display pixels 42).

As depicted, a controller 48 is communicatively coupled to the data drivers 46. The controller 48 may instruct the data drivers 46 to provide one or more data signals to the display pixels 42. The controller 48 may also instruct the scan drivers 44 to provide one or more control signals to the display pixels 42 (via the data drivers 46). While the controller 48 is shown as part of the display panel 40, it should be understood that the controller 48 may be external to the display panel 40. Moreover, the controller 48 may be communicatively coupled to the scan drivers 44 and the data drivers 46 in any suitable arrangement (e.g., only directly coupled to the scan drivers 44, directly coupled to both the scan drivers 44 and the data drivers 46, and the like). The controller 48 may include one or more processors 50 and one or more memory devices 52. In some embodiments, the processor(s) 50 may execute instructions stored in the memory device(s) 52. Thus, in some embodiments, the processor(s) 50 may be included in the processor core complex 18, the image processing circuitry 26, a timing controller (TCON) in the electronic display 12, and/or a separate processing module. Additionally, in some embodiments, the memory device(s) 52 may be included in the local memory 20, the main memory storage device 22, and/or one or more separate tangible, non-transitory, computer readable media.

The controller 48 may control the display panel 40 to display an image frame at a target luminance or brightness. For example, the controller 48 may receive image data from an image data source that indicates the target luminance of one or more display pixels 42 for displaying an image frame. The controller 48 may display the image frame by controlling magnitude and/or duration of current supplied to light-emission components to facilitate achieving the target luminance. For example, the controller 48 may use a switching element to control the magnitude of the current supplied to the light-emission components or a duration of the application of current to the light-emission components.

That is, the controller 48 may cause display of the image frame for a target emission period, which may be a ratio or percentage of a total display period of the image frame. For example, if the target luminance of the image frame is 60% of a maximum luminance available of the electronic display, the controller 48 may switch on the display pixels to emit light for a ratio or percentage (e.g., 60%) of a display period of the image frame that results in displaying the image frame at the target luminance. The controller 48 may switch off light emitting devices of the display pixels to stop emitting light for the remainder (e.g., 40%) of the display period. In this manner, the controller 48 may instruct the display panel 40 to display the image frame at the target luminance. In some embodiments, the controller 48 may also control magnitude of the current supplied to enable light emission to control luminance of the image frame.

Figure 7:
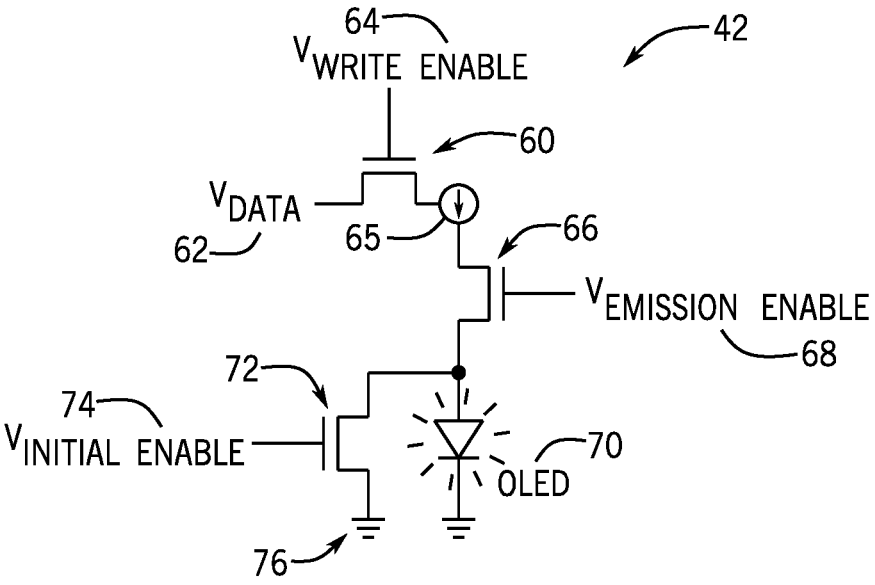
FIG. 7 is a schematic diagram of a display pixel of the electronic display of FIG. 6, in accordance with an embodiment of the present disclosure.

A more detailed view of a display pixel 42 is shown in FIG. 7. The display pixel 42 includes a switching device, such as a transistor 60. In certain embodiments, the transistor 60 may include any suitable component or components that provide switching and storage functionality (e.g., one or more switches and/or capacitors). The transistor 60 may provide a data voltage 62, $V_{data}$, when in a conducting state. The data voltage 62 may be provided by a data signal line coupled to a data driver 46. The transistor 60 may operate in a conducting or non-conducting state based on a write enable voltage 64, $V_{write\ enable}$, which may be provided by a scan signal line coupled to a scan driver 44. In particular, the controller 48 may instruct the scan driver 44 to send the write enable voltage 64 to set the transistor 60 in the conducting state and instruct the data driver 46 to send the data voltage 62 that programs a programmable current source 65 of the display pixel 42 to produce a target current, for example, by selectively connecting to a power supply with or without a feedback loop. In this manner, the controller 48 may program an output (e.g., color, luminance, and the like) of the display pixel 42 via the transistor 60. The controller 48 may also instruct the data driver 46 to send a reset signal or voltage via the data voltage 62 to reset the programmable current source 65. The reset voltage may be any suitable voltage that resets or relaxes the transistor 60 and reduces hysteresis by overwriting previous image data stored in the transistor 60. In some embodiments, the reset voltage may be associated with default image data supplied by the programmable current source 65. The default image may be independent of the image data used to display an image frame to sufficiently reset or relax the transistor 60.

The display pixel 42 includes a switching device, such as a transistor 66. In alternative embodiments, the transistor 66 may include any suitable component or components that provide switching and/or storage functionality (e.g., a switch and/or a capacitor). The transistor 66 may selectively provide current from the programmable current source 65 to light emitting device, such as an organic light emitting diode (OLED) 70. The transistor 66 may operate in a conducting or non-conducting state based on an emission enable voltage 68, $V_{emission\ enable}$, which may be provided by a scan signal line coupled to a scan driver 44. When in the conducting state, the transistor 66 may provide the current from the programmable current source 65 to the OLED 70. In particular, the controller 48 may instruct the scan driver 44 to send the emission enable voltage 68 to set the transistor 66 in the conducting state, thereby electrically coupling the programmable current source 65 to the OLED 70. As described above, the output (e.g., color, luminance, and the like) of the OLED 70 may be controlled based on the magnitude of supplied current and/or duration current is supplied to the OLED 70. In this manner, the controller 48 may control an output (e.g., luminance, duration of emission, and the like) of the OLED 70.

The display pixel 42 also includes a transistor 72. In alternative embodiments, the transistor 72 may include any other suitable component or components. The transistor 72 may provide an initial voltage 76 (e.g., ground) to the display pixel 42 to initialize the display pixel 42 when in a conducting state. The transistor 72 may operate in a conducting or non-conducting state based on an initial enable voltage 74, $V_{initial\ enable}$, which may be provided by a scan signal line coupled to a scan driver 44. While the initial voltage 76 is a ground voltage (e.g., zero voltage) in FIG. 7, it should be noted that the initial voltage 76 may be any suitable voltage used to initialize the display pixel 42 to prepare the display pixel 42 to display an image frame.

When transitioning between successive frames, light emission in display pixels 42 associated with displaying a first frame may lag thereby negatively impacting light emission in display pixels 42 associated with displaying a subsequent (e.g., second) frame known as hysteresis. Hysteresis may be caused by a magnitude of a constant current supplied by the programmable current source 65 coupled to the OLED 70 used to display a previous frame affecting a magnitude of a constant current used to display a subsequent frame, thus affecting the luminance of the display pixels 42 when displaying the subsequent frame. Hysteresis may cause slow response time of the display pixels 42 and reduce perceived image quality (e.g., by creating ghost images or mura effects).

Moreover, perceivability of the hysteresis effects may increase at lower target luminance/greyscale levels because a ramp rate of a display pixel 42 may be effected by the magnitude of constant current output from the programmable current source 65. That is, the higher the current output from the programmable current source 65, the faster the voltage and current across the OLED 70 may ramp, thus reaching a steady target luminance faster, and vice versa. Because the ramp rate is unaffected by an emission duration, and image data with a lower target luminance is displayed with a shorter emission duration, ramping before reaching the steady state luminance uses a larger portion of the display period of the image frame.

Figure 8:
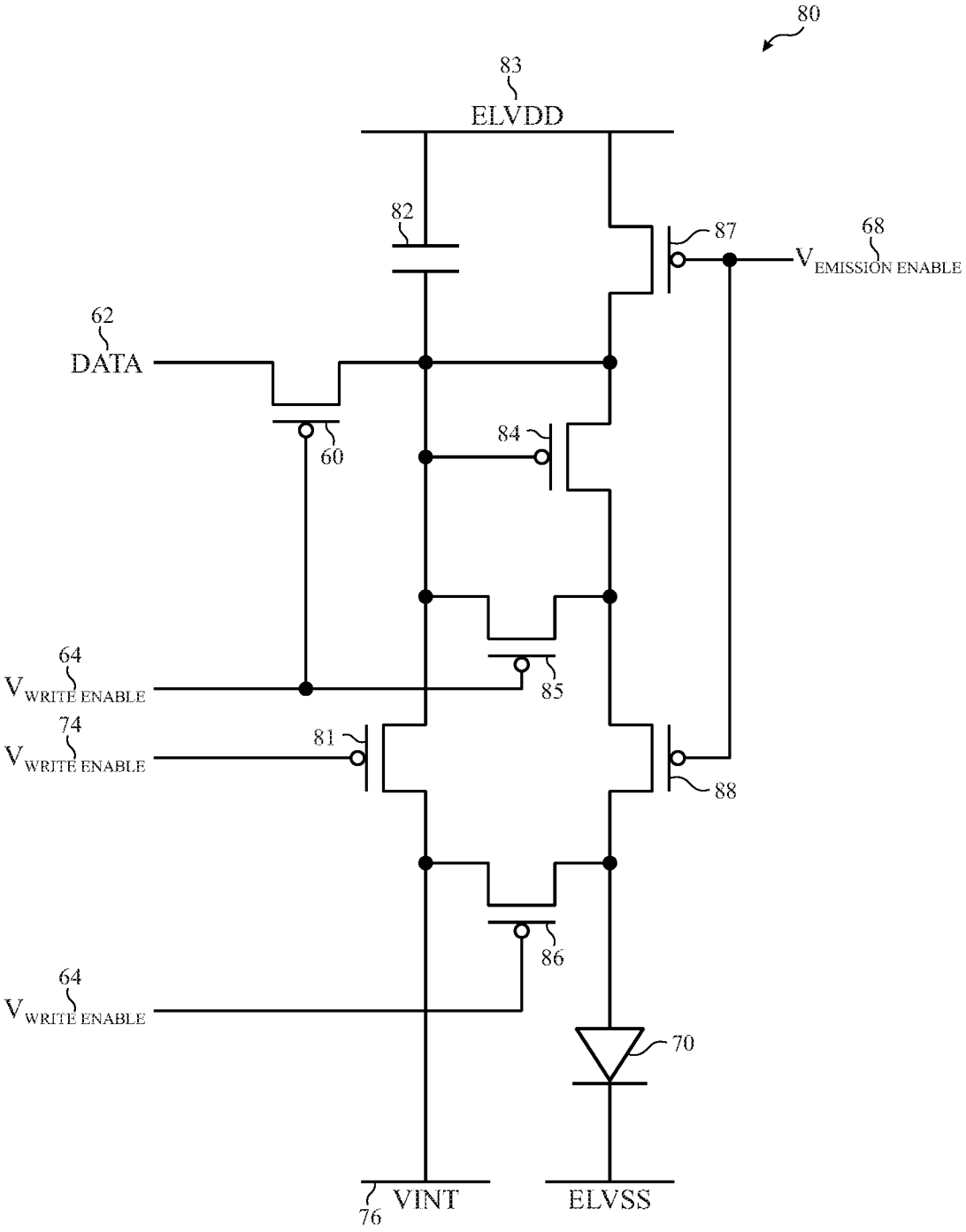
FIG. 8 is a schematic diagram of a display pixel of the electronic display of FIG. 6, in accordance with an embodiment of the present disclosure.

FIG. 8 illustrates an alternative embodiment of a display pixel 80 that receives the data voltage 62, the write enable voltage 64, the emission enable voltage 68, and the initial enable voltage 74 and uses the transistor 60 to gate the data voltage 62 for the OLED 70. The initial enable voltage 74 is used to control a transistor 81 that may be used to connect the initial voltage 76 to a capacitor 82. In other words, the initial enable voltage 74 may be used along with ELVDD 83 to charge and/or discharge the capacitor 82. The voltage at the capacitor 82 may be applied to a gate of a transistor 84 to control connection of the OLED 70 to the data voltage 62 when passed through the transistor 60 and emission is turned on using the emission enable voltage 68.

A transistor 85 may receive the write enable voltage 74 that controls whether the respective drain of the transistor 81 is coupled to the source of the transistor 84. In other words, this transistor 85 may be used to connect and disconnect lines in the display pixel 80 to control writing of data for the display pixel 80. Transistor 86 works similarly to enable/disable writing of the data voltage 62 to the display pixel 80 based on the assertion of the write enable voltage 64. Transistors 87 and 88 control whether emission from the OLED 70 is enabled based on assertion of the emission enable voltage 68.

Figure 9:
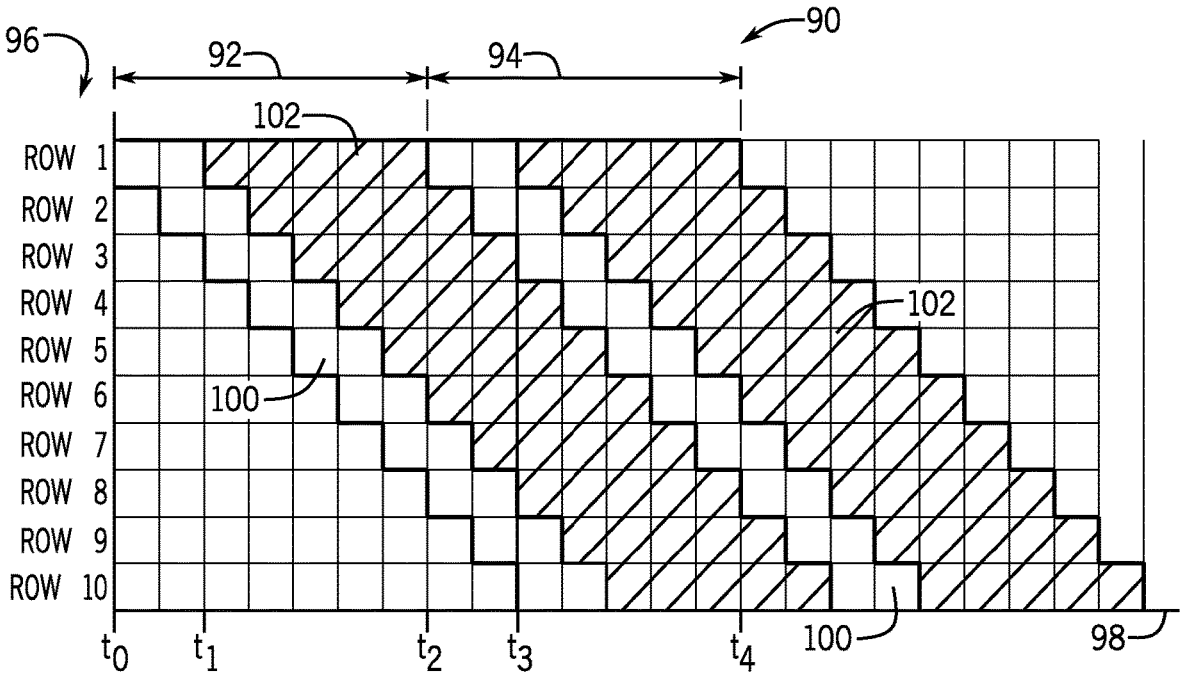
FIG. 9 is an example timing graph of display pixels displaying two image frames, in accordance with an embodiment of the present disclosure.

To aid in illustration, an example timing graph 90 describing operation of display pixels for displaying a first image frame 92 followed by a second image frame 94 is shown in FIG. 9. The vertical axis 96 of the graph 90 represents display pixels of each row (e.g., rows 1-10) of a display panel, and the horizontal axis 98 represents time. As illustrated, each row is first programmed with image data during a programming period 100. Before the programming period 100, the display pixel row may be instructed to stop emitting light. After the programming period 100, each row emits light to display the pixels of the row during an emission period 102. For example, a controller may program display pixel Row 1 from $t_0$ to $t_1$, instruct Row 1 to emit light from $t_1$ to $t_2$, program display pixel Row 1 again from $t_2$ to $t_3$, and instruct Row 1 to emit light again from $t_3$ to $t_4$. As illustrated, the controller may sequentially program each subsequent display pixel row (e.g., Row 2) with image data, instruct each subsequent row to emit light, and instruct each subsequent row to stop emitting light.

Figure 10:
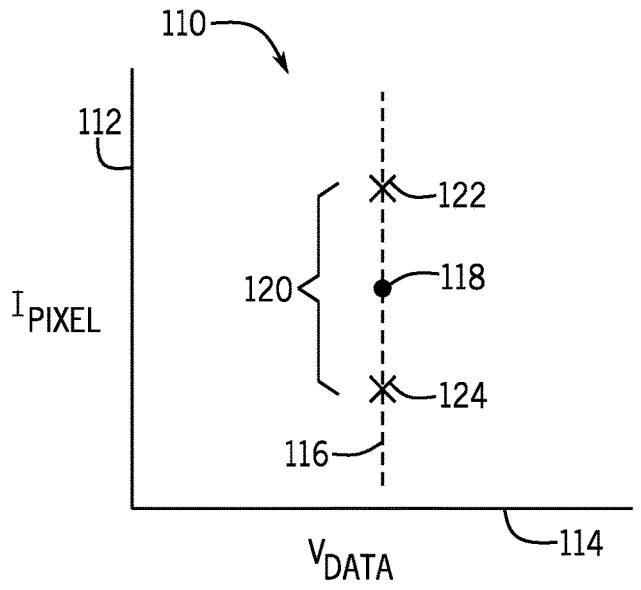
FIG. 10 is an example graph showing a current-voltage characteristic of a display pixel of FIG. 7 or 8, in accordance with an embodiment of the present disclosure.

However, when transitioning between frame 92 and frame 94, light emission in display pixels associated with displaying frame 92 may lag, negatively impacting light emission in display pixels associated with displaying frame 94. FIG. 10 is an example graph showing a current-voltage characteristic 110 of a display pixel of FIG. 9. The vertical axis 112 of the graph represents current in the display pixel 42 and the horizontal axis 114 represents voltage of a data signal (e.g., associated with image data) provided to the display pixel. The data voltage 116 (e.g., data voltage 62) may illustrate a certain voltage associated with image data for the display pixel to display. An ideal or target current-voltage 118 represents a target current (and thus luminance) the display pixel at which the display pixels nominally displays the image data. However, due to hysteresis, an actual current-voltage may vary from the target current-voltage 118. In particular, a range 120 of current-voltage may illustrate actual current-voltage due to hysteresis (from displaying a previous image frame). A first endpoint 122 of the range 120 may represent a case where the previous image frame is black (e.g., 0% luminance). A second endpoint 124 of the range 120 may represent a case where the previous image frame is white (e.g., 100% luminance). As such, hysteresis from displaying the previous image frame may cause luminance variance from an ideal or target luminance when displaying a subsequent image frame.

To reduce the likelihood of hysteresis affecting perceived image quality, the controller 48 may reset the display pixels 42 by applying a reset voltage. Applying the reset voltage to the display pixels 42 may relax the display pixels 42 by overwriting previous image frame data, which otherwise may result in hysteresis. The controller 48 may reset the display pixels 42 during a non-emission period of the display pixels 42 (e.g., after the controller 48 instructs the display pixels 42 to stop emitting light).

Figure 11:
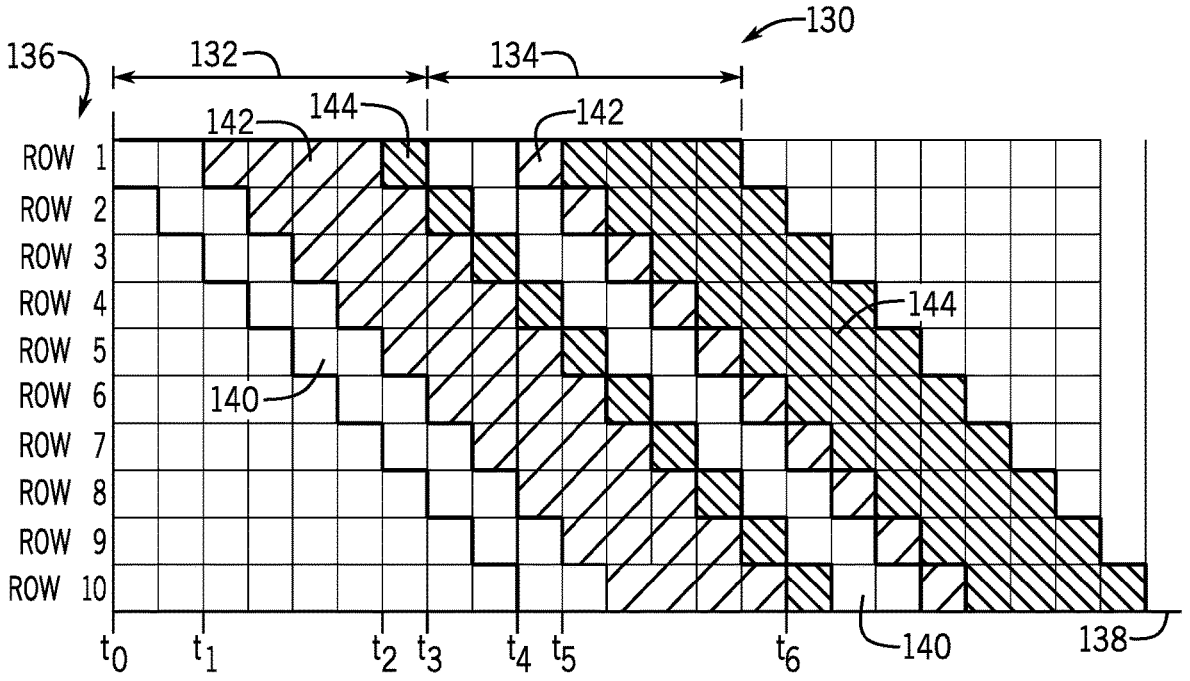
FIG. 11 is an example timing graph of the display pixels of FIG. 7 or 8 displaying two image frames, in accordance with an embodiment of the present disclosure.

To help illustrate, an example timing graph 130 describing operation of the display pixels 42 for displaying a first image frame 132 followed by a second image frame 134 is shown in FIG. 11. The vertical axis 136 of the graph 130 represents display pixels 42 of each row (e.g., rows 1-10) of the display panel 40, and the horizontal axis 138 represents time. As illustrated, each row is first programmed with image data during a programming period 140. Before the programming period 140, the display pixel row may be instructed to stop emitting light. After the programming period 140, each row emits light to display the pixels 42 of the row during an emission period 142. After the emission period 142, the controller 48 instructs each row to stop emitting light and reset during a reset period 144. For example, the controller 48 may program display pixel Row 1 from $t_0$ to $t_1$, instruct Row 1 to emit light from $t_1$ to $t_2$, instruct Row 1 to stop emitting light and reset display pixel Row 1 from $t_2$ to $t_3$, program display pixel Row 1 again from $t_3$ to $t_4$, instruct Row 1 to emit light again from $t_4$ to $t_5$, and instruct display pixel Row 1 to stop emitting light and reset display pixel Row 1 from $t_5$ to $t_6$.

In other words, the controller 48 may sequentially program each display pixel row (e.g., Row 2) with image data, instruct each row to emit light, instruct each row to stop emitting light, and instruct each row to reset. FIG. 11 also illustrates a difference between displaying image frames of different luminance. For example, Row 1 emits light when displaying frame 132 for a time period (i.e., from $t_1$ to $t_2$) that is greater than that of frame 134 (i.e., from $t_4$ to $t_5$). Resetting a row of display pixels 42 immediately or shortly after the row stops emitting light may increase relaxation duration, thereby reducing likelihood that hysteresis due to display of a previous frame (e.g., frame 132) affects perceived image quality of a subsequent frame (e.g., frame 134).

In some embodiments, the controller 48 may display an image frame using pulse-width modulation (PWM) as part of dimming control. In particular, the controller 48 may display multiple noncontiguous refresh pixel groups associated with multiple portions of the image frame, resulting in a faster refresh rate. In such cases, the controller 48 may reset the programmable current source 65 after a last refresh pixel group to reduce hysteresis.

Figure 12:
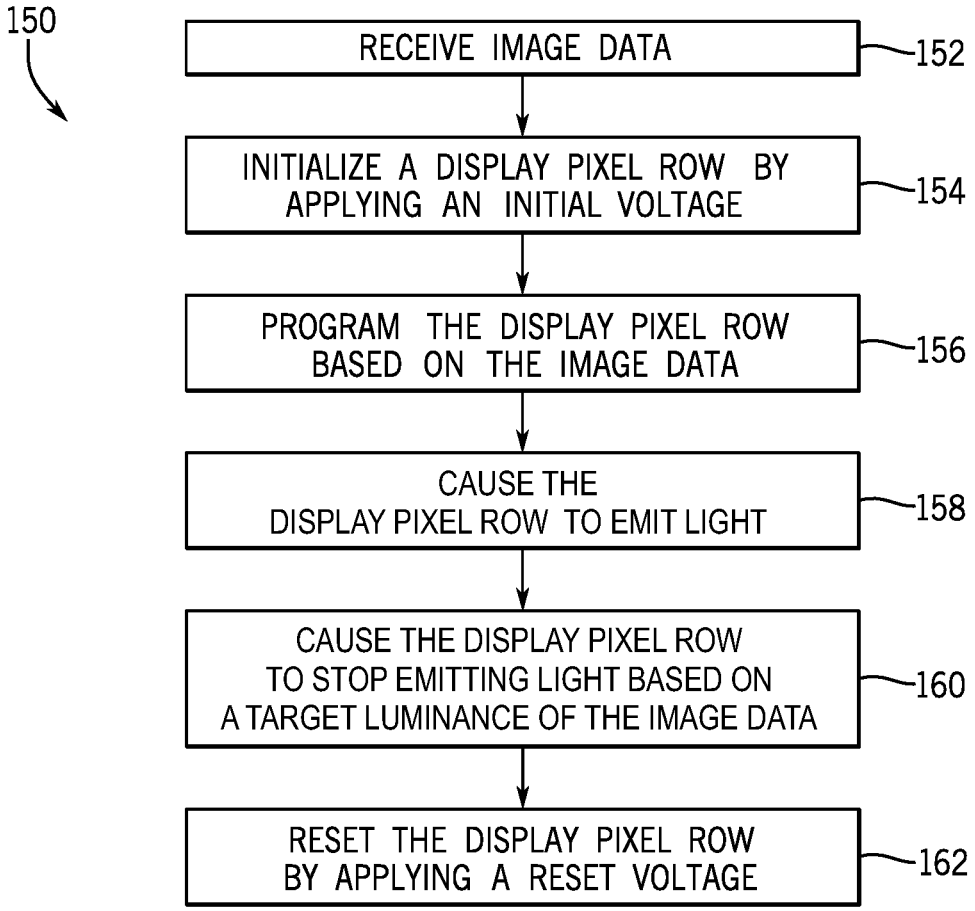
FIG. 12 is a flow diagram of a process for resetting the display pixel of FIG. 7 or 8 to improve display response time, in accordance with an embodiment of the present disclosure.

One embodiment of a process 150 for resetting the display pixel 42 of FIG. 7 to improve display response time is described in FIG. 12. The process 150 may be implemented by the display driver circuitry 38. In some embodiments, the process 150 may be implemented by executing instructions stored in a tangible, non-transitory, computer-readable medium, such as the memory device(s) 52, using a processor, such as the processor(s) 50.

As illustrated, the controller 48 may receive image data (block 152). For example, the controller 48 may receive content of an image frame from an image data source. In some embodiments, the content may include information related to luminance, color, variety of patterns, amount of contrast, change of image data corresponding to an image frame compared to image data corresponding to a previous frame, and/or the like. The controller 48 may also initialize a display pixel row by applying an initial voltage to the display pixel row (block 154). The initial voltage may be a ground voltage or any other suitable voltage that may be used to initialize the display pixel row.

The controller 48 may then program the display pixel row based on the image data (block 156). For example, the controller 48 apply a data voltage based on the image data (e.g., a corresponding pixel row of the image data) to the programmable current source 65 such that it produces a target current expected to result in target luminance. The controller 48 may cause the display pixel row to emit light (block 158) once the display pixel row has been programmed. In some embodiments, the controller 48 cause a display pixel row to emit light in response to completing the programming of the display pixel row, thereby setting when the emission period of the display pixel row begins.

The controller 48 may then cause the display pixel row to stop emitting light based on a target luminance of the image data (block 160). For example, if the target luminance of the image data is 60% of a maximum luminance available of the display panel 40, the controller 48 may cause the pixel row to stop emitting light after a ratio or percentage (e.g., 60%) of a display period of the image frame has passed, resulting in displaying the image frame at the target luminance. When the start of the emission period is set, the current is supplied to the OLED 70 for a set duration that may be controlled by adjusting when the display pixel row stops The controller 48 may reset the display pixel row by applying a reset voltage to the display pixel row (block 162). The reset voltage may be any suitable voltage that resets or relaxes the display pixel row and reduces hysteresis by overwriting previous image data stored in the display pixel row. In some embodiments, the reset voltage may be associated with default image data supplied by the programmable current source 65. The default image may be independent of the image data used to display an image frame to sufficiently reset or relax the display pixel row. For example, the controller 48 may instruct each display pixel in the display pixel row to use a data signal different from data signals associated with the image frame. In additional or alternative embodiments, the reset voltage may be associated with another data voltage based on the image data (e.g., a non-corresponding pixel row of the image data).

Thus, in some embodiments, the controller 48 may reset the display pixel row in response to the display pixel row stopping light emission. In this manner, the display pixel row may be reset immediately after or shortly after the emission is stopped, thereby increasing a length of a relaxation period and, thus, reducing likelihood of hysteresis inhibiting perceived image quality of subsequent image frames.

The process 150 may be used to display image data and reset multiple display pixel rows of the display panel 40. Because the scan drivers 44 of the display panel 40 may be connected together in a linear series, such that a single control signal may be sent to the set of scan drivers 44 to display an image frame, the single control signal may be used to perform the process 150. Timing of the control signal may be controlled by propagation of the control signal through the set of scan drivers 44.

Figure 13:
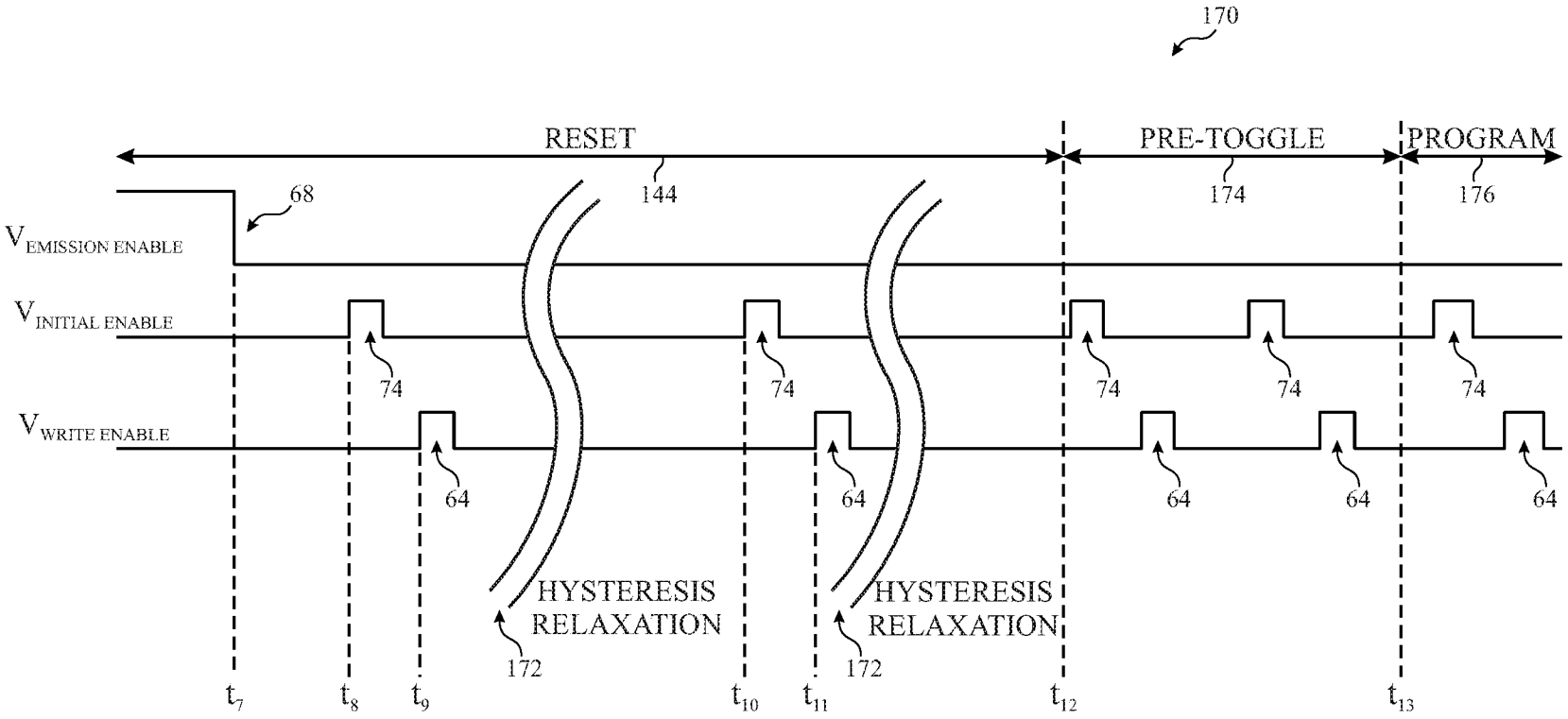
FIG. 13 is a timing diagram for using multiple reset signals to reset the display pixel of FIG. 7 or 8, in accordance with an embodiment of the present disclosure.

Referring back to block 162 of the process 150, FIG. 13 provides an example timing diagram 170 for applying a reset voltage to reset the display pixel row. In some embodiments, during the reset period 144, the emission enable voltage 68, $V_{emission\ enable}$, may be set to a voltage value (e.g., low voltage value) at time $t_7$. After the emission enable voltage 68 is set to the voltage value, the controller 48 may instruct the scan driver 44 or other suitable component to set the initial enable voltage 74, $V_{initial\ enable}$, to the transistor 72 (or the transistor 81, if present) at time $t_9$. Soon thereafter, at time $t_9$, the controller 48 may instruct the scan driver 44 to send the write enable voltage 64, $V_{write\ enable}$, to the transistor 60 (and the transistors 85 and 86, if present). The data voltage 62, which may include the reset voltage or reset signal, may then be provided to the OLED 70.

As mentioned above, after the reset voltage is provided to the OLED 70, the OLED 70 may reset or relax to compensate for the hysteresis effect described above. In some embodiments, the controller 48 may provide just one reset voltage via the data voltage 62 prior to programming the respective OLED 70. However, to further improve the reduction of the hysteresis effect, the controller 48 again may send the initial enable voltage 74, $V_{initial\ enable}$, to the transistor 72 (or the transistor 81, if present) at time $t_{10}$ and send the write enable voltage 64, $V_{write\ enable}$, to the transistor 60 (and the transistors 85 and 86, if present) at time $t_{11}$ to further prevent hysteresis from causing luminance variance from a target luminance when displaying a subsequent image frame.

Although FIG. 13 illustrates using two reset signals during the reset period 144, it should be noted that any suitable number of reset signals may be sent to the OLED 70 to sufficiently reduce the likelihood of hysteresis affecting the image quality depicted on the display 12. For example, after each reset signal is provided to the OLED 70 as shown in the timing diagram 170, a hysteresis relaxation period 172 may occur.

After resetting the OLED 70 using the one or more reset signals, the controller 48 may begin to pre-toggle the OLED 70 during a pre-toggle period 174 (e.g., between time $t_{12}$ and time $t_{13}$) to exercise the OLED 70 before programming the OLED 70 with the desired data voltage. That is, the controller 48 may pre-toggle the OLED 70 during the pre-toggle period 174 to improve the response time and accuracy of the OLED 70, to reduce the effects of previously stored data in the OLED 70 from a previous image frame, and/or to reduce cross-talk between data voltages provided between adjacent frames of image data.

When pre-toggling the OLED 70, the controller 48 may provide a pre-toggle voltage value via the data voltage 62 to exercise or prepare the OLED 70 to receive a voltage value that corresponds to a desired image data, as received via the data voltage 62. That is, before a programming period 176, the controller 48 may instruct the scan driver 44 or other suitable component to send one or more pre-toggle signals to the OLED 70 via the data voltage 62. In some embodiments, the number of pre-toggle signals and/or the width of the pre-toggle signals transmitted to the OLED 70 may be determined based on certain intrinsic properties (e.g., refresh rate, cross-talk tests, etc.) of the display 12. After pre-toggling the OLED 70, the controller 48 may instruct the scan driver 44 to send target data voltage signals to the OLED 70 via the data voltage 62 based on received image data to be depicted on the display 12.

Figure 14:
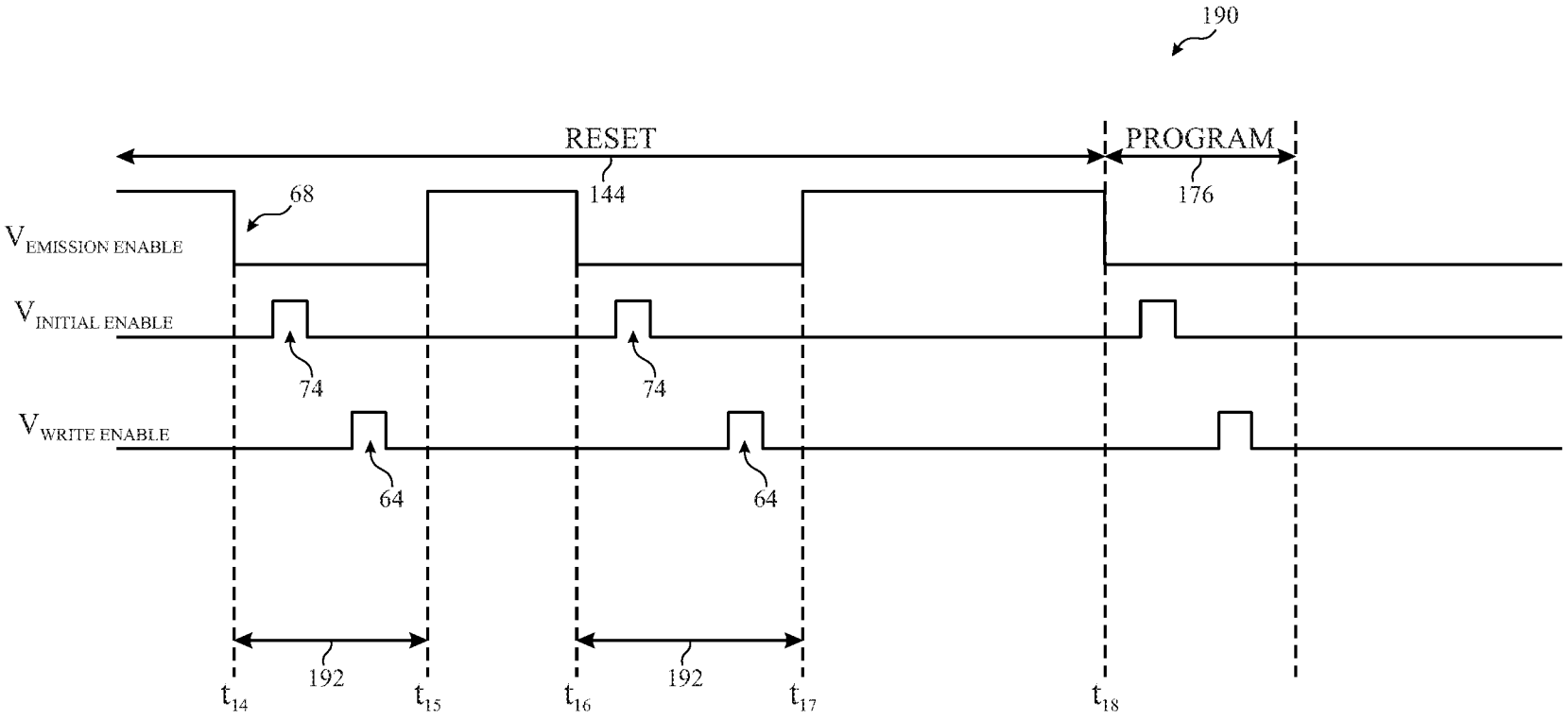
FIG. 14 is a timing diagram for using emission pre-toggling prior to writing data in the display pixel of FIG. 7, in accordance with an embodiment of the present disclosure.

Although pre-toggling the OLED 70 may enable the OLED 70 to more accurately present the image data, the use of various circuit components (e.g., clocks, transistors) to perform the pre-toggling operations may result in an inefficient use of energy or power. That is, each time the initial enable voltage 74 signal and the write enable voltage 64 signal is provided to the respective transistors, power is consumed by certain circuit components to provide these signals to their respective destinations. As such, to reduce the number of pre-toggling signals sent to the OLED 70, the controller 48 may implement an emission pre-toggle sequence, as illustrated in the timing diagram 190 of FIG. 14.

The emission pre-toggle sequence may include, for example, using one or more reset signals while toggling the emission enable voltage 68, $V_{emission\ enable}$. Referring to the timing diagram 190 of FIG. 14, in one embodiment, the controller 48 may instruct the scan driver 44 or other suitable component to reduce the emission enable voltage 68 signal from a high voltage value to a low voltage value at time $t_{14}$. During the time period when the emission enable voltage signal is reduced, the controller 48 may send the initial enable voltage 74 signal and the write enable voltage 64. At time $t_{15}$, the emission enable voltage signal is returned to a high voltage value. As such, between time t14 and time t15, the controller 48 may reset the OLED 70, as described above. However, instead of keeping the emission enable voltage 68 signal low, the controller 48 may cause the emission enable voltage 68 signal to cycle back to a high voltage and then to a low voltage value at time $t_{16}$. When the emission enable voltage 68 signal returns to a low voltage value, the controller 48 may again reset the OLED 70 by transmitting the initial enable voltage 74 signal and the write enable voltage 64 to the respective transistors with the reset signal as the data voltage 62. At time t17, the controller 48 may return the emission enable voltage 68 signal to the high voltage value, thereby preventing the programmable current source 65 from coupling to the OLED 70. Although two emission pre-toggle cycles 192 are described in the timing diagram 190 to reset the light emitting device, it should be noted that the controller 48 may incorporate any suitable number of emission pre-toggle cycles 192 in the reset period 144.

After the reset period 144, at time $t_{18}$, the controller 48 may program the OLED 70 during the program period 176, as described above. By employing the emission pre-toggle cycles 192 to reset the OLED 70, the controller 48 may effectively reduce or eliminate pre-toggling the OLED 70 with a pre-toggle voltage during the pre-toggle period 174. That is, in some embodiments, the controller 48 may avoid pre-toggling the OLED 70 by employing the emission pre-toggle sequence described herein. As a result, the controller 48 may provide additional power savings for the display 12 while reducing cross-talk between frames of image data.

Although the foregoing descriptions of the reset period 144 and the pre-toggle period 174 are described as employing an initial enable voltage 74 signal and a write enable voltage 64 for each reset and pre-toggle operation, in some embodiments, the controller 48 may instead just transmit the initial enable voltage 74 signals, as opposed to both the initial enable voltage 74 signal and the write enable voltage 64 signal. That is, for some types of display or for displays that operate at certain refresh rates, the transmission of the initial enable voltage 74 signal may cause the OLED 70 to be coupled to ground, which may be used as the reset voltage, and may effectively reset the OLED 70 to reduce the hysteresis effect and cross-talk effects between frames of image data. Indeed, by using just the initial enable voltage 74 signal, the controller 48 may reduce the ability of cross-talk between image frames because the write enable voltage 64 signal is not provided to connect the data voltage 62, which may correspond to a previous frame of image data, to the OLED 70. Moreover, by avoiding the transmission of the write enable voltage 64 signal, the controller 48 may reduce the power consumed by the display pixel 42.

Figure 15:
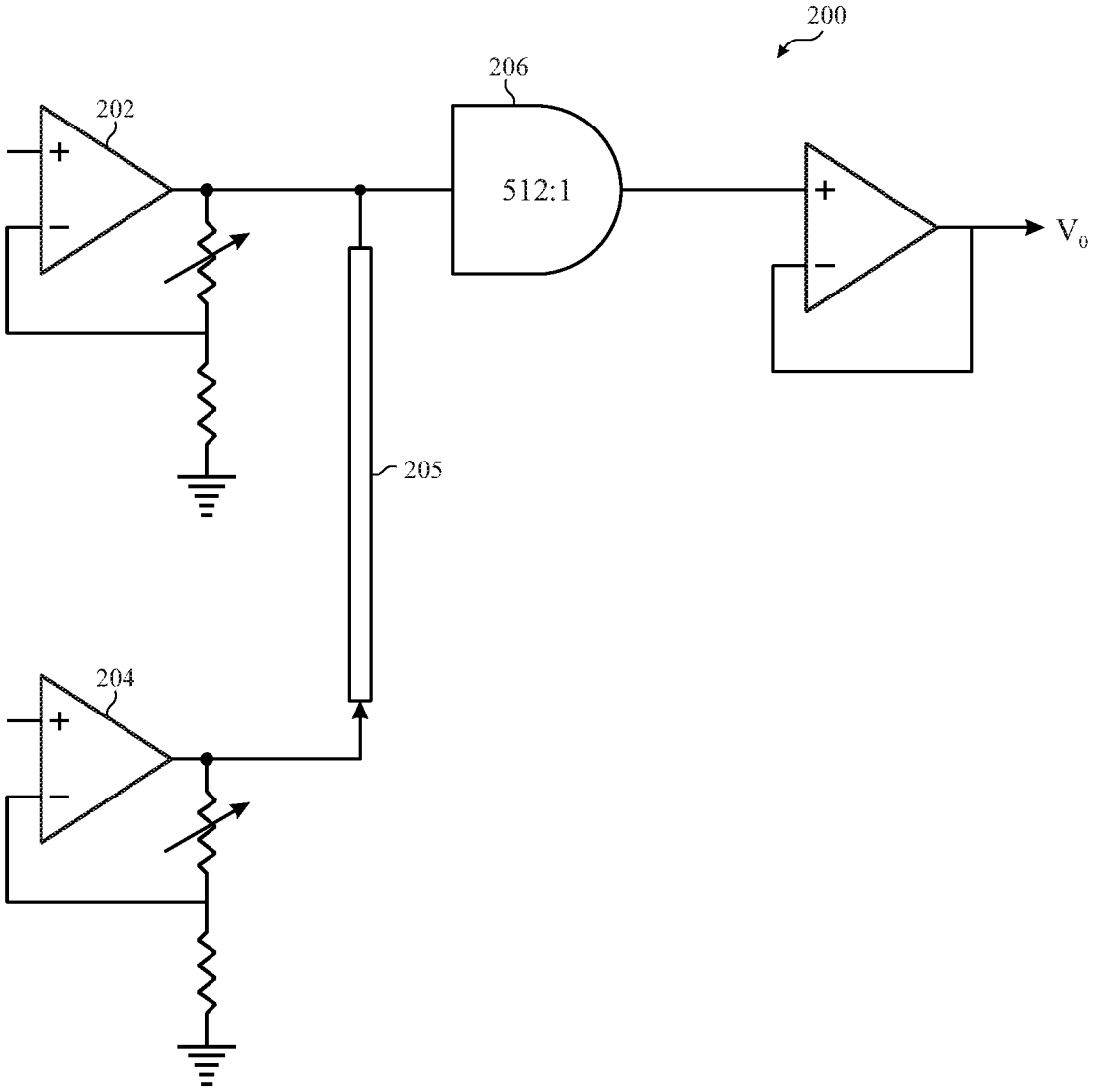
FIG. 15 is a circuit diagram for adjusting a grey zero level based on a brightness level of a display pixel, in accordance with an embodiment of the present disclosure.

In addition to employing the various reset and pre-toggling operations described above to reduce cross-talk and hysteresis effects on the display pixel 42, the controller 48 or other suitable component may adjust a greyscale level zero voltage value used for grey zero values (G0) in the display pixel 42. That is, the greyscale level zero voltage value (V0) provided to the OLED 70 as data voltage 62 for greyscale level zero may contribute to the hysteresis effect due to its dependence on the display brightness value (DBV), the color of the display pixel 42, the refresh rate of the display 12, the temperature of the display 12, and the like. With this in mind, in some embodiments, a voltage adjustment circuit 200, as illustrated in FIG. 15 may be included in the display 12 to adjust the voltage value (V0) used for depicting the greyscale level zero. For example, as the brightness setting for the display 12 increases, the voltage adjustment circuit 200 may increase the voltage value (V0) used for greyscale level zero (G0).

Referring to FIG. 15, the voltage adjustment circuit 200 may include a high voltage source 202 and a low voltage source 204 that provides a first voltage value and a second voltage value, respectively. The first voltage value may be higher than the second voltage value. The voltage adjustment circuit 200 may also include a resistor string 205 that may provide different voltage outputs based on the collection of resistors that make up the resistor string 205. In certain embodiments, the controller 48 may receive a display brightness setting value (DBV) for the display 12 and determine a greyscale level zero voltage value (V0) for the greyscale level zero based on the DBV. In some embodiments, voltage values (V0) may be mapped to DBV during a testing operation performed during manufacturing or the like. Generally, the testing operations may track the presence of the hysteresis effect on the display pixel 42 for different DBVs over different greyscale level zero voltage values (V0).

Based on the determined greyscale level zero voltage value (V0), the controller 48 or other suitable component may select a voltage output from the resistor string 205 via a multiplexer 206. The output of the multiplexer 206 may then be provided to the scan drivers 44 and/or the data drivers 46 to present greyscale level zeros on the pixels 42 or the OLED 70. By adjusting the greyscale level zero voltage value (V0) based on the DBV employed by the display 12, the controller 48 may prevent the pixels 42 from being affected by content depicted on previous frames of image data and the brightness employed by the display 12. As a result, the image depicted by the display 12 may have fewer artifacts and present higher quality image data.

As appreciated, pre-toggling may be used to improve display response and image sticking. However, with an increase of display resolution increasing a number of pixels in the display 12 and/or an increase in refresh rate decreasing recovery periods after programming a pixel, effectiveness of a single pre-toggle decreases. To counter this decrease effect, pixels may be pre-toggled more times to achieve consistent display response and image sticking performance on high-resolution/high-refresh-rate displays. One way to reduce processing used for the pre-toggling process is to use programming for a current row of pixels in a programming period to pre-toggle previous rows of pixels that have recently been written and are currently in a pre-toggling period. However, cross-talk between row pixels caused by such distributing of programming signals may effect image quality of the image being displayed by introducing pre-toggling-induced artifacts on the display 12, such as ghosting.

Figure 16:
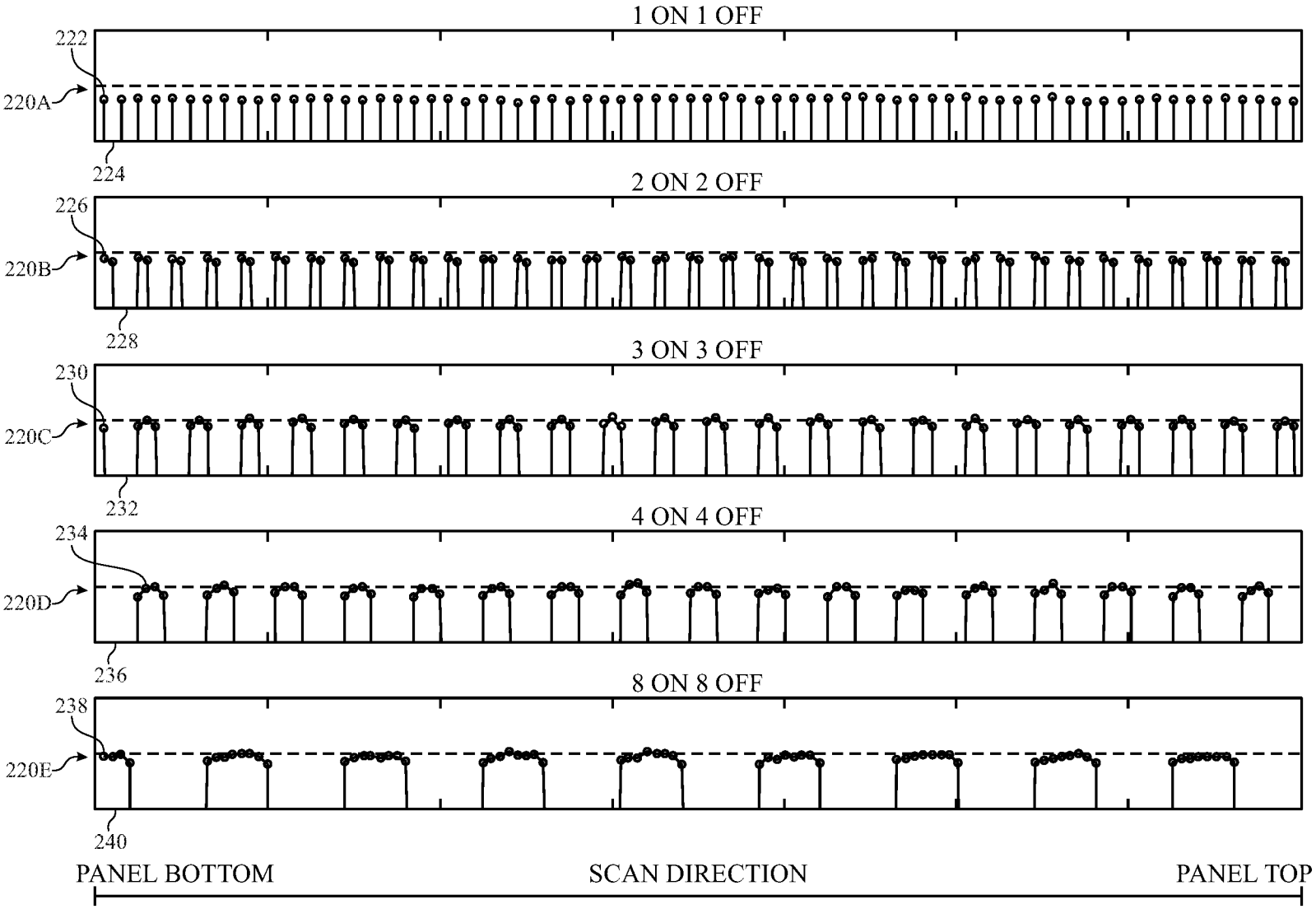
FIG. 16 is a graph of example image data for the display of FIG. 1, in accordance with an embodiment.

To aid in illustrating such possible artifacts, FIG. 16 illustrates graphs 220A, 220B, 220C, 220D, and 220E showing sample programming for pixels in the display 12 without implementing pre-toggling. For example, graph 220A includes alternating rows of white pixels 222 and black pixels 224 each row. Graph 220B includes alternating rows of white pixels 226 and black pixels 228 with two consecutive rows programmed white and two consecutive rows programmed black repeating through the display 12. Like graph 220B, graph 220C includes alternating rows of white pixels 230 and black pixels 232 with three consecutive rows programmed white and three consecutive rows programmed black repeating through the display 12. Likewise, graph 220D includes alternating rows of white pixels 234 and black pixels 236 with four consecutive rows programmed white and four consecutive rows programmed black repeating through the display 12. Similarly, graph 220E includes alternating rows of white pixels 238 and black pixels 240 with eight consecutive rows programmed white and eight consecutive rows programmed black repeating through the display 12. These values are presented for illustration purposes, but any combination of suitable values for the pixels of the display 12 may be used in other embodiments. As illustrated, each of the consecutive white pixels generally form a square shape in the graphs 220B, 220C, 220D, and 220E.

Figure 17:
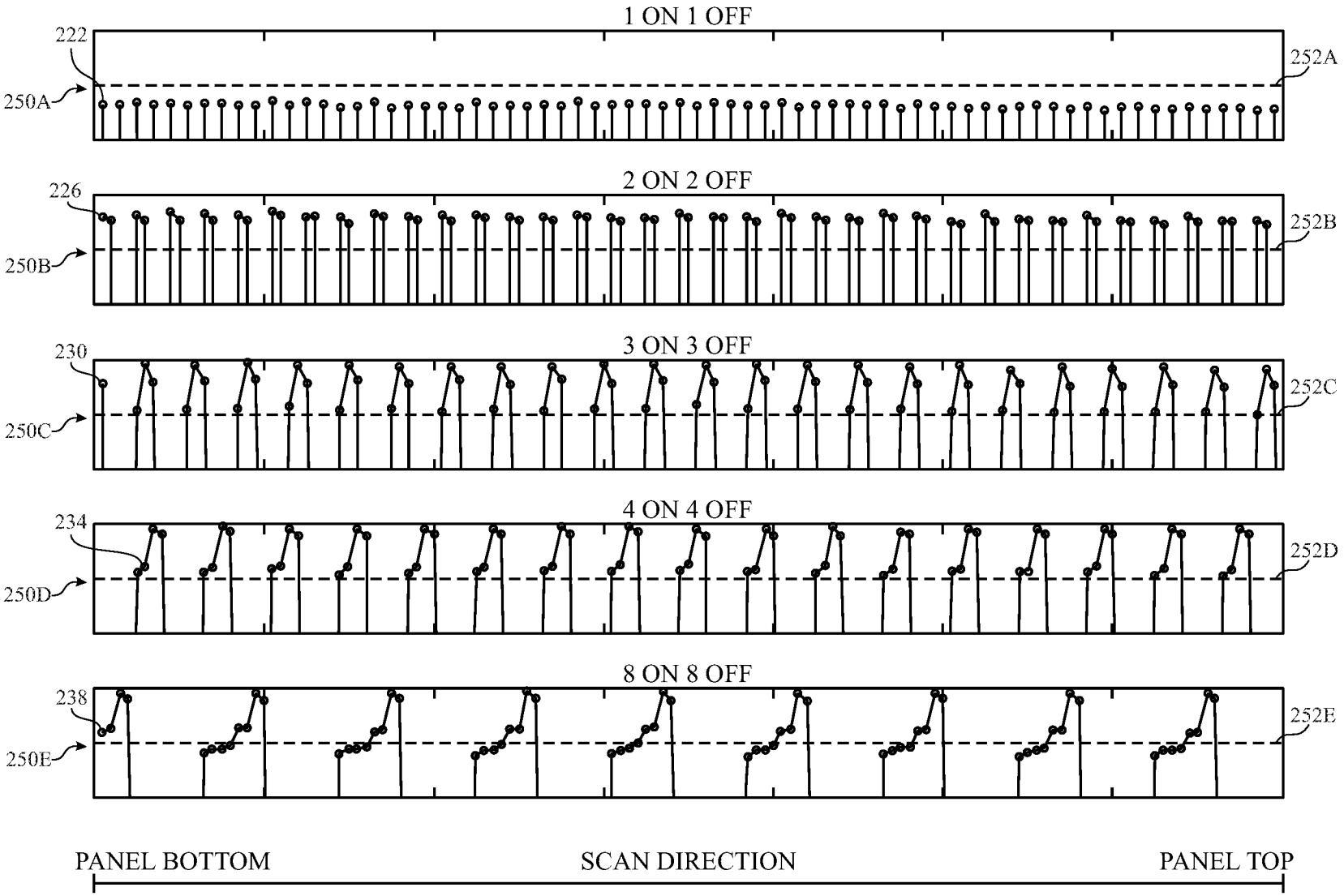
FIG. 17 is a graph of the example image data of FIG. 16 when pre-toggling is applied using the example image data.

FIG. 17 illustrates graphs 250A, 250B, 250C, 250D, and 250E that show the sample programming patterns of the graphs 220A, 220B, 220C, 220D, and 220E with distributed pre-toggling applied. As illustrated, the graph 250A shows a variation by the white pixels 222 from a target level 252A corresponding to an approximation of a level of the white pixels 222 in the graph 220A. The graph 250B shows a larger variation by the white pixels 226 from a target level 252B corresponding to an approximation of a level of the white pixels 226 in the graph 220B. Similarly, the graph 250C shows a variation by the white pixels 230 from a target level 252C corresponding to an approximation of a level of the white pixels 230 in the graph 220C. Likewise, the graph 250D shows a variation by the white pixels 234 from a target level 252D corresponding to an approximation of a level of the white pixels 234 in the graph 220D, and the graph 250E shows a variation by the white pixels 238 from a target level 252E corresponding to an approximation of a level of the white pixels 2238 in the graph 220E.

Furthermore, graphs 250D and 250E also illustrate that the cross-talk causes a general change of shape from the generally square shape of the corresponding luminance distributions of the white pixels 234 and 238 in graphs 220D and 220E that is a toggling-induced artifact resulting from content changing in the data from row-to-row. For instance, when consecutive previous pixel rows have luminance values that are relatively low (e.g., black), subsequent relatively high (e.g., white) pixel row values may be negatively impacted due to cross-talk. For instance, the relatively low value may introduce a higher bias $V_{GS}$ of the transistor 84 during initialization time of the display pixel 80 since the source voltage of the transistor 84 of the display pixel 80 may be at least partial defined by the previous row data of other previously written rows due to the cross-talk.

Moreover, in some embodiments, the artifacts illustrated in the graphs 250A, 250B, 250C, 250D, and 250E may be generally independent of distance from driver within the display 12 as the artifacts are distributed somewhat uniformly throughout the display 12. Instead, the artifacts may be largely content dependent for the previous row data for rows to which the data is being written for pre-toggling. Furthermore, this content dependency may be greater for pixel rows that are physically closer to the row being driven. The amount of cross-talk may also depend on pixel luminance of the pixel.

Figure 18:
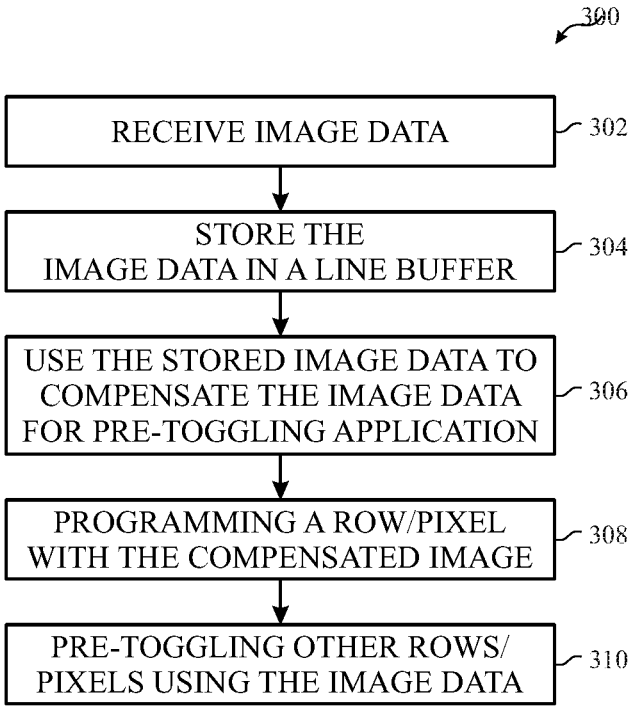
FIG. 18 is a flow diagram of a process for pre-toggling rows of pixels of the display of FIG. 1, in accordance with an embodiment.

To account for cross-talk, the processor core complex 18, the controller 48, and/or the pre-toggling compensation circuitry 27 may perform a pre-compensation process, such as the process 300 illustrated in FIG. 18. The process 300 includes receiving incoming image data for a pixel or a row of pixels (block 302). The processor core complex 18/the controller 48/pre-toggling compensation circuitry 27 then stores the image data in a line buffer with stored image data for other pixels or rows of pixels (block 304). The other pixels or rows of pixels have already been programmed and/or already undergone emission of the corresponding stored image data. The processor core complex 18/the controller 48/pre-toggling compensation circuitry 27 then utilizes contents of stored image data of the line buffer to compensate the incoming image data for predicted cross-talk due to using the received image data being used for pre-toggling the other pixels or rows of pixels (block 306). For example, the compensation may be model-based or look-up-table (LUT) based to predict how much cross-talk is likely to occur on the incoming data when the incoming data is used to pre-toggle pixels/rows of pixels corresponding to the stored image data. For instance, the greyscale levels of the stored image data may be used to pre-compensate the incoming data for the cross-talk since the level of cross-talk is dependent on the content of the pixels/rows of pixels being pre-toggled. Once the incoming data is compensated, the compensated incoming data is used to program the pixel or row of pixels (block 308) and to pre-toggle the pre-toggled pixels/rows of pixels corresponding to the stored image data (block 310). In some embodiments, the compensated incoming data is supplied to the pixel or row of pixels and the pre-toggled pixels/rows at the same or substantially the same time.

Figure 19:
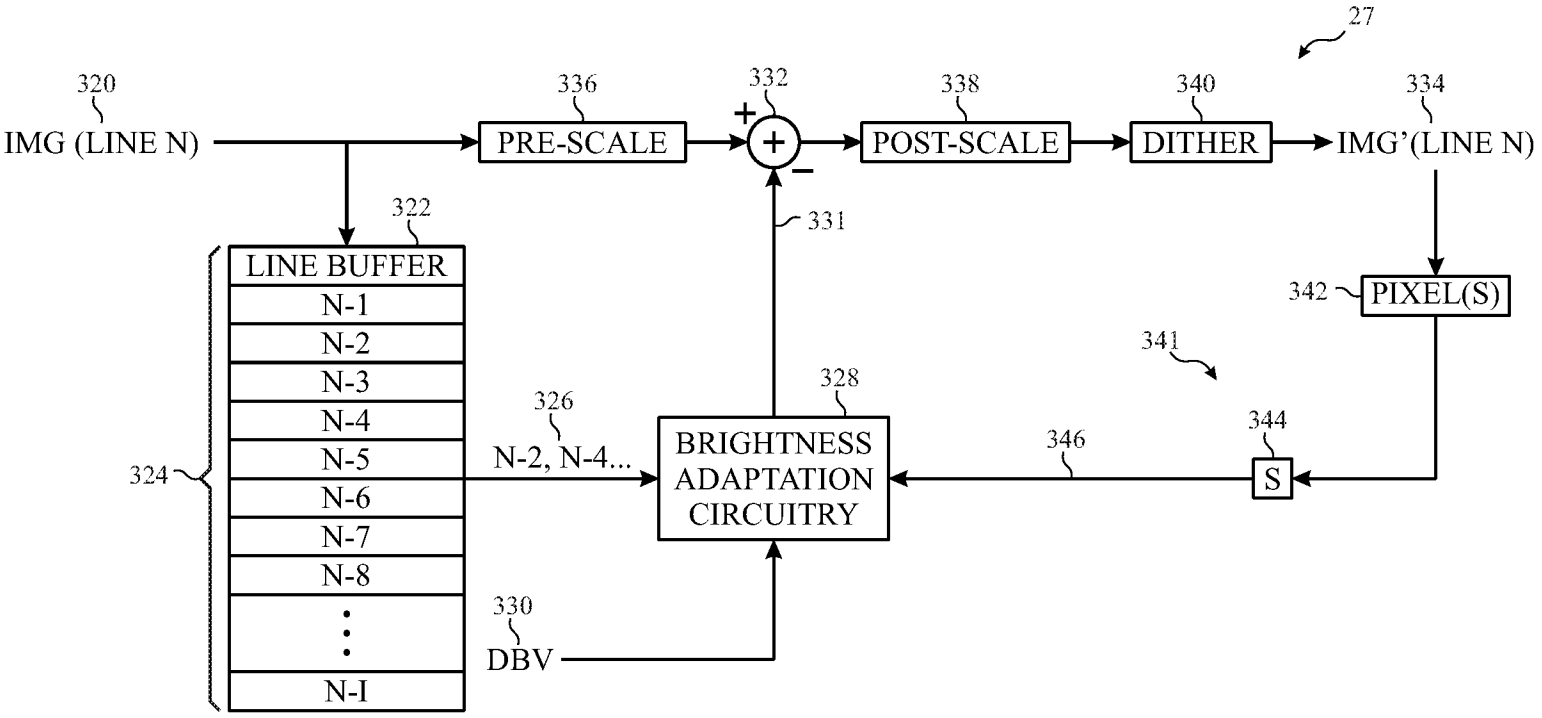
FIG. 19 is a block diagram of a pre-toggling compensation circuitry of FIG. 1, in accordance with an embodiment.

FIG. 19 illustrates a block diagram of an embodiment of the pre-toggling compensation circuitry 27. As illustrated, the pre-toggling compensation circuitry 27 receives image data 320 for a pixel/row of pixels and stores the image data 320 in a line buffer 322 that includes entries 324 for previous pixels/rows of pixels. The line buffer 322 may have any number of entries 324. For example, the length of the line buffer 322 store a number (e.g., 12) of entries that is equal to the number (e.g., 12) of rows back that are pre-toggled. In some embodiments, pre-toggling may only be performed on a subset of previous pixels/rows with the image data 320. For example, the pre-toggling may be performed on every other row, such that image data 320 for row n is used to pre-toggle rows n−2, n−4, and so forth. Other intervals may be used in other embodiments.

The pre-toggling compensation circuitry 27 may select any of the entries to which the image data 320 may be applied for pre-toggling. The pre-toggle data 326 is then passed to brightness adaption circuitry 328 that pre-compensates the image data 320 by offsetting predicted cross-talk on the image data 320 due to application of the image data 320 to data rows corresponding to the pre-toggle data. For example, a model may be derived for mapping what cross-talk the content of the pre-toggle data 326 will cause based on the delta between pixel rows in the line buffer 322 and the image data 320. For instance, each of the entries 324 may be weighted in the pre-toggle data 326 according to location relative to the row of pixels corresponding to the image data 320 where closer pixels are weighted more heavily. Furthermore, the model may compensate more heavily for some values due to sensitivity to artifacts based on the greyscale level of the image data. For example, in some embodiments, a display 12 may be more sensitive to artifacts at medium-low greyscale levels due to device characteristics. In such embodiments, the pre-toggle compensation circuitry 27 may be more aggressive in pre-compensation.

Additional to or alternative to the model-based brightness adaption, the brightness adaption circuitry 328 may include LUT-based compensation where the LUT is filled using empirical data. In some embodiments, to reduce a size of the LUT, the LUT may include only key points between which values are to be interpolated.

Regardless of whether the brightness adaption circuitry 328 utilizes model-based and/or LUT-based adaption, the brightness adaption circuitry 328 may scale its pre-compensation based on a digital brightness value (DBV) 330 that is used to set a global brightness level for the display 12. For example, the brightness adaption circuitry 328 may scale compensation values 331 using the DBV 330.

The compensation values 331 are then combined with the image data 320 using combination circuitry 332 to generate pre-compensated image data 334 that compensates for cross-talk on the image data line due to application of the pre-compensated image data 334 to pixels for pre-toggling.

In some embodiments, the compensation values 331 may cause the image data 320 to pass a permissible value. For example, if the image data 320 includes an 8-bit greyscale level of 254, addition of the compensation values 331 greater than one may cause the pre-compensated image data 334 to surpass a permitted value of 255. For instance, the compensation of the pre-compensated image data 334 may cause the image data 320 to pass from a relatively bright value (e.g., 254) to a relatively dark value (e.g., 5) due to wraparound. To prevent such an occurrence, the pre-toggling compensation circuitry 27 may include pre-scale circuitry 336 and post-scale circuitry 338. The pre-scale circuitry 336 may create some margin for compensation of brightness values in the image data near either end of the spectrum before combination in the combination circuitry 332. The post-scale circuitry 338 may remove the scaling to return to appropriate brightness levels for the pre-compensated image data 334.

The pre-toggling compensation circuitry 27 may include dither circuitry 340 to enable the display to display additional levels of precision. The dither circuitry 340 yields higher precision of correction by enabling half-greyscale levels or quarter-greyscale levels by averaging pixels in an area/over time to increase position. In other words, the dither circuitry 340 may provide temporal and/or spatial dithering to increase luminance precision.

In some embodiments, the brightness adaption circuitry 328 may be refined over time using a feedback loop 341. When the pre-compensated image data 334 is used to drive pixel(s) 342. A sensor 344 may be used to track whether the target luminance is achieved. In some embodiments, the sensor 344 may be a brightness sensor that measures the luminance of the pixel(s) directly or a current sensor that measures current through the pixel indicative of the luminance. The output 346 of the sensor 344 may be used to refine the model and/or LUT used by the brightness adaption circuitry 328.

Although the foregoing descriptions of the operation of the display pixel 42, 80 may be described with p-type and/or n-type transistors, it should be noted that the embodiments described herein may also be implemented using other transistor types. In this case, the polarities or voltage values of each of the various signals and voltages described above may be adjusted accordingly based on the type of switching device used to control the operation of the display pixel 42, 80.

The specific embodiments described above have been shown by way of example, and it should be understood that these embodiments may be susceptible to various modifications and alternative forms. It should be further understood that the claims are not intended to be limited to the particular forms disclosed, but rather to cover all modifications, equivalents, and alternatives falling within the spirit and scope of this disclosure.

The techniques presented and claimed herein are referenced and applied to material objects and concrete examples of a practical nature that demonstrably improve the present technical field and, as such, are not abstract, intangible or purely theoretical. Further, if any claims appended to the end of this specification contain one or more elements designated as "means for [perform]ing [a function] . . . " or "step for [perform]ing [a function] . . . ", it is intended that such elements are to be interpreted under 35 U.S.C. 112(f). However, for any claims containing elements designated in any other manner, it is intended that such elements are not to be interpreted under 35 U.S.C. 112(f).

What is claimed is:

1. An electronic display, comprising:

a display panel comprising a plurality of rows of pixels; and pre-toggling circuitry configured to use image data corresponding to a row of pixels of the plurality of rows of pixels to toggle switching circuitry of other rows of pixels of the plurality between emission periods of the other rows of pixels, wherein the pre-toggling circuitry comprises pre-toggling compensation circuitry configured to pre-compensate the image data for predicted cross-talk in the image data between the plurality of rows of pixels due to supplying the image data to each of the plurality of rows of pixels, and the pre-compensation is performed before application of the image data to pre-toggle the other rows of pixels and application of the image data to program the row of pixels.

2. The electronic display of claim 1, wherein the pre-toggling compensation circuitry is configured to pre-compensate the image data based at least in part on content of the other rows of pixels.

3. The electronic display of claim 2, wherein the pre-toggling compensation circuitry comprises a line buffer configured to store previous image data from the other rows of pixels that were programmed prior to programming the row of pixels.

4. The electronic display of claim 3, wherein the pre-toggling compensation circuitry is configured to store the image data in the line buffer for use in determining pre-toggling compensation for subsequent rows of pixels programmed after the row of pixels, wherein the image data is stored in the line buffer before the pre-compensation of the image data is performed.

5. The electronic display of claim 1, wherein the pre-toggling compensation circuitry is configured to apply the pre-compensated image data to the row of pixels and the other rows of pixels at the same time.

6. The electronic display of claim 1, wherein the pre-toggling compensation circuitry comprises a look-up table (LUT) used to apply the pre-compensation of the image data to the image data.

7. The electronic display of claim 6, wherein the LUT is used to determine a compensation level for the pre-compensation of the image data based at least in part on contents of the other rows of pixels.

8. The electronic display of claim 7, wherein the compensation level is based at least in part on a digital brightness value (DBV) that corresponds to a global brightness setting for the display panel.

9. The electronic display of claim 1, wherein the pre-toggling compensation circuitry comprises a model used to determine a compensation level for the pre-compensation of the image data based at least in part on contents of the other rows of pixels.

10. The electronic display of claim 9, wherein the model is used to determine a compensation level for the pre-compensation of the image data based at least in part on contents of the other rows of pixels.

11. A method comprising:

receiving image data at pre-toggle compensation circuitry that pre-compensates the image data for cross-talk between a plurality of rows of pixels of an electronic display, wherein the image data indicates greyscale levels for the plurality of rows of pixels;

storing the image data in a line buffer;

pre-compensating, using at least a portion of the stored image data, a programming portion of the image data as pre-compensated data to compensate for the cross-talk between the plurality of rows of pixels of the electronic display when pre-toggling a first subset of the plurality of rows of pixels corresponding to the at least a portion of the stored image data;

programming a second subset of the plurality of rows of pixels using the pre-compensated data; and pre-toggling the first subset of the plurality of rows of pixels using the pre-compensated data, wherein pre-toggling each row of the first subset of the plurality of rows of pixels occurs between emission periods of the respective row.

12. The method of claim 11 comprising generating a compensation level based at least in part on greyscale levels of the at least a portion of the stored image data, wherein pre-compensating the programming portion of the image data as pre-compensated data comprises combining the compensation level with the programming portion as the pre-compensated data.

13. The method of claim 12, wherein generating the compensation level is based at least in part on a look-up table or model.

14. The method of claim 12, wherein generating the compensation level is based at least in part on a digital brightness value (DBV) that corresponds to a global brightness level for the electronic display.

15. The method of claim 11 comprising:

scaling the programming portion before pre-compensating the programming portion; and de-scaling the pre-compensated data.

16. The method of claim 11 comprising dithering greyscale levels of one or more pixels in the pre-compensated data to enable increases luminance precision by averaging luminance values to provide fractional levels of the greyscale levels.

17. The method of claim 16, wherein dithering the greyscale levels comprises spatial dithering averaging pixels of the one or more pixels.

18. The method of claim 16, wherein dithering the greyscale levels comprises temporal dithering averaging greyscale levels over time.

19. An electronic device comprising:

an input configured to receive image data for a plurality of pixels of a display of the electronic device;

a line buffer configured to store the image data;

brightness adaption circuitry configured to pre-compensate a to-be-programmed portion of the image data using previously programmed portions of the image data stored in the line buffer, wherein the pre-compensation is configured to compensate for cross-talk between the plurality of pixels induced by pre-toggling a first subset of the plurality of pixels corresponding to the previously programmed portions of the image data while driving a second subset of the plurality of pixels; and an output configured to:

output the pre-compensated to-be programmed portion to the first subset of the plurality of pixels to pre-toggle the first subset of the plurality of pixels; and output the pre-compensated to-be programmed portion to the second subset of the plurality of pixels to program the second subset of the plurality of pixels.

20. The electronic device of claim 19, wherein the brightness adaption circuitry is configured to select alternating rows in the line buffer as the previously programmed portions of the image data.

21. The electronic device of claim 20, wherein the brightness adaption circuitry comprises a lookup table or a model to generate a compensation level to be combined with the to-be-programmed portion to create a pre-compensated programming portion based at least in part on greyscale levels of the previously programmed portions of the image data.

22. A method comprising:

receiving first image data for a row of pixels of an electronic display;

fetching second image data for previously programmed rows of pixels of the electronic display;

pre-compensating the first image data for predicted cross-talk between the row of pixels and the previously programmed rows of pixels when applying the first image data to program the row of pixels and to pre-toggle the previously programmed rows of pixels, wherein pre-compensating the first image data is based at least in part on the second image data;

programming the row of pixels using the pre-compensated first image data; and pre-toggling the previously programmed rows of pixels using the pre-compensated first image data.

23. The method of claim 22, wherein the pre-compensated first image data is applied to the row of pixels and the previously programmed rows of pixels at the same time.

24. The method of claim 22, wherein pre-compensating the first image data comprises predicting the cross-talk based at least in part on greyscale levels in the second image data.

25. The method of claim 24, wherein pre-compensating the first image data comprises predicting the cross-talk based at least in part on a digital brightness value (DBV) that corresponds to a global brightness level for the electronic display.

* * * * *